US011535032B2

(12) United States Patent
Araki

(10) Patent No.: US 11,535,032 B2
(45) Date of Patent: Dec. 27, 2022

(54) LIQUID DISCHARGE APPARATUS AND HEAD DRIVE CONTROL DEVICE

(71) Applicant: Satomi Araki, Kanagawa (JP)

(72) Inventor: Satomi Araki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/100,035

(22) Filed: Nov. 20, 2020

(65) Prior Publication Data

US 2021/0162746 A1 Jun. 3, 2021

(30) Foreign Application Priority Data

Nov. 29, 2019 (JP) ..... JP2019-217428

(51) Int. Cl.
*B41J 29/38* (2006.01)
*B41J 2/045* (2006.01)

(52) U.S. Cl.
CPC ..... *B41J 2/04581* (2013.01); *B41J 2/04588* (2013.01)

(58) Field of Classification Search
CPC ..... B41J 2/04581; B41J 2/04588
See application file for complete search history.

(56) References Cited

FOREIGN PATENT DOCUMENTS

| | | |
|---|---|---|
| JP | 2015-174404 | 10/2015 |
| JP | 2017-170652 | 9/2017 |
| JP | 2018-509320 | 4/2018 |
| WO | WO2016/142645 A1 | 9/2016 |

*Primary Examiner* — Lam S Nguyen
(74) *Attorney, Agent, or Firm* — Harness, Dickey & Pierce, P.L.C.

(57) ABSTRACT

A liquid discharge apparatus includes a liquid discharge head and circuitry. The liquid discharge head includes a nozzle to discharge liquid. The circuitry is configured to: generate and output a common drive waveform including a drive pulse for discharging liquid from the nozzle of the liquid discharge head; select a waveform portion of the drive pulse to be applied to a pressure generating element of the liquid discharge head; and output a selection signal for designating the waveform portion selected. The drive pulse includes at least an expansion waveform element for expanding a pressure chamber of the liquid discharge head and a holding waveform element for holding a state expanded by the expansion waveform element. The selection signal includes a deselection signal for deselecting at least a part of a waveform portion preceding the expansion waveform element having, as a terminal, a state held by the holding waveform element.

7 Claims, 21 Drawing Sheets

| | NOZZLE n1 | NOZZLE n2 |
|---|---|---|
| DISCHARGE SPEED | FAST | MODERATE |
| SELECTION SIGNAL | A | B |

FIG. 19

| | HEAD DRIVE FREQUENCY | SELECTION SIGNAL | TRIMMING WAVEFORM |
|---|---|---|---|
| DRIVE CONDITION A | 10 kHz | A | PA |
| DRIVE CONDITION B | 60 kHz | B | PB |

FIG. 20

| | PRINT MODE | SELECTION SIGNAL | TRIMMING WAVEFORM |
|---|---|---|---|
| DRIVE CONDITION A | 1200 × 1200dpi | A | PA |
| DRIVE CONDITION B | 600 × 600dpi | B | PB |

LIQUID DISCHARGE APPARATUS AND HEAD DRIVE CONTROL DEVICE

CROSS-REFERENCE TO RELATED APPLICATION

This patent application is based on and claims priority pursuant to 35 U.S.C. § 119(a) to Japanese Patent Application No. 2019-217428, filed on Nov. 29, 2019, in the Japan Patent Office, the entire disclosure of which is hereby incorporated by reference herein.

BACKGROUND

Technical Field

Embodiments of the present disclosure relate to a liquid discharge apparatus and a head drive control device.

Related Art

In a liquid discharge head, the discharge speed and the discharge amount of liquid vary among heads or nozzles due to, for example, variations in manufacturing.

For example, there is known a technique for adjusting the trimming range from an expansion waveform element (in other words, falling waveform element) for expanding a pressure chamber to a holding waveform element for holding an expanded state in a common drive waveform.

SUMMARY

In an aspect of the present disclosure, there is provided a liquid discharge apparatus includes a liquid discharge head and circuitry. The liquid discharge head includes a nozzle to discharge liquid. The circuitry is configured to: generate and output a common drive waveform including a drive pulse for discharging liquid from the nozzle of the liquid discharge head; select a waveform portion of the drive pulse to be applied to a pressure generating element of the liquid discharge head; and output a selection signal for designating the waveform portion selected. The drive pulse includes at least an expansion waveform element for expanding a pressure chamber of the liquid discharge head and a holding waveform element for holding a state expanded by the expansion waveform element. The selection signal includes a deselection signal for deselecting at least a part of a waveform portion preceding the expansion waveform element having, as a terminal, a state held by the holding waveform element.

In another aspect of the present disclosure, there is provided a head drive control device includes circuitry. The circuitry is configured to: generate and output a common drive waveform including a drive pulse for discharging liquid from a nozzle of a liquid discharge head; select a waveform portion of the drive pulse to be applied to a pressure generating element of the liquid discharge head; and output a selection signal for designating the waveform portion selected. The drive pulse includes at least an expansion waveform element for expanding a pressure chamber of the liquid discharge head and a holding waveform element for holding a state expanded by the expansion waveform element. The selection signal includes a deselection signal for deselecting at least a part of a waveform portion preceding the expansion waveform element having, as a terminal, a state held by the holding waveform element.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 19 is a table of an example of the relationship between the drive conditions and the selection signals;

FIG. 20 is a table of another example of the relationship between the drive conditions and the selection signals;

Figure 1:
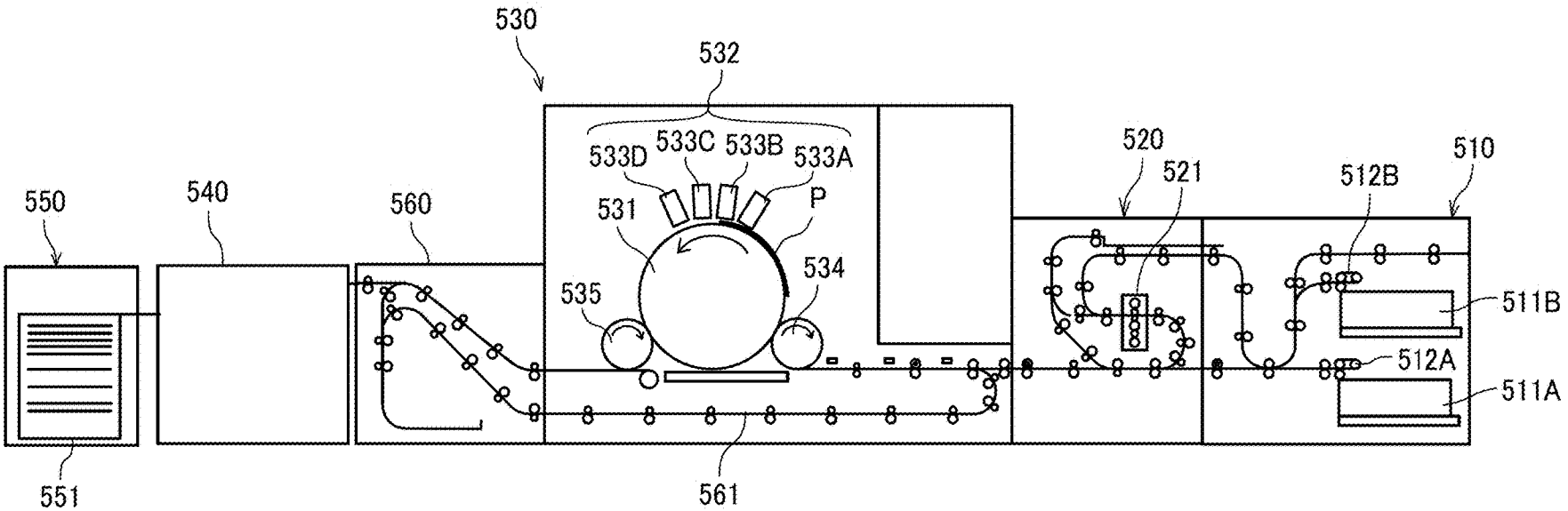
FIG. 1 is a schematic view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
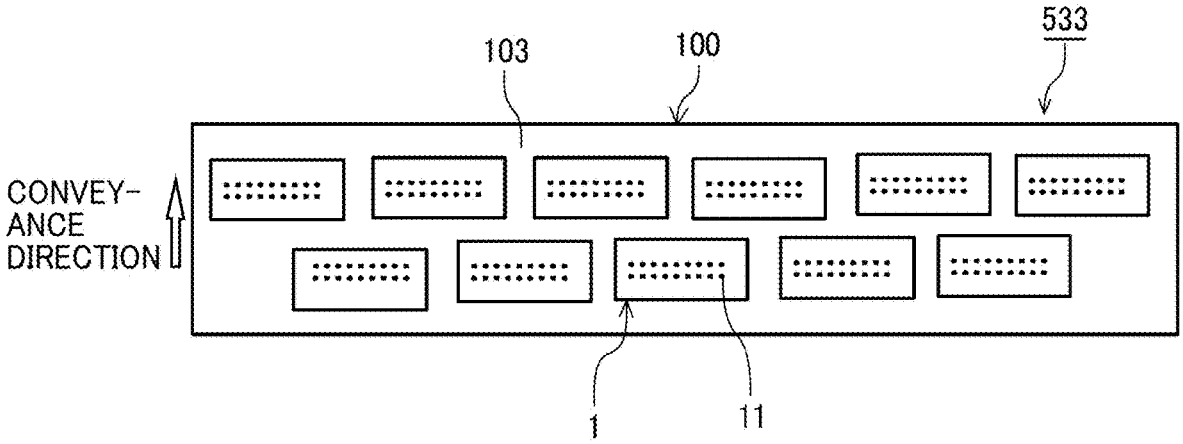
FIG. 2 is a plan view of a discharge unit of the printer of FIG. 1.

Referring now to the drawings, wherein like reference numerals designate identical or corresponding parts throughout the several views, exemplary embodiments of the present disclosure are described below. A printer as a liquid discharge apparatus according to a first embodiment of the present disclosure is described with reference to FIGS. 1 and 2. FIG. 1 is a schematic view of the printer according to the first embodiment. FIG. 2 is a plan view of a discharge unit of the printer.

A printer 500 according to the present embodiment includes a loading unit 510 to load a sheet P into the printer 500, a pretreatment unit 520, a printing unit 530, a drying unit 540, and an unloading unit 550. In the printer 500, the pretreatment unit 520 applies, as required, pretreatment liquid onto the sheet P fed (supplied) from the loading unit 510, the printing unit 530 applies liquid to the sheet P to perform printing, the drying unit 540 dries the liquid adhering to the sheet P, and the sheet P is ejected to the unloading unit 550.

The loading unit 510 includes loading trays 511 (e.g., a lower loading tray 511A and an upper loading tray 511B) to accommodate a plurality of sheets P and feeding devices 512 (e.g., a feeding device 512A and a feeding device 512B) to separate and feed the sheets P one by one from the loading trays 511, and supplies the sheets P to the pretreatment unit 520.

The pretreatment unit 520 includes, e.g., a coater 521 as a treatment-liquid applying device that coats an image formation surface of a sheet P with a treatment liquid having an effect of aggregating ink particles to prevent bleed-through.

The printing unit 530 includes a drum 531 and a liquid discharge device 532. The drum 531 is a bearer (rotating member) that bears the sheet P on a circumferential surface of the drum 531 and rotates. The liquid discharge device 532 discharges liquid toward the sheet P borne on the drum 531.

The printing unit 530 includes transfer cylinders 534 and 535. The transfer cylinder 534 receives the sheet P from the pretreatment unit 520 and forwards the sheet P to the drum 531. The transfer cylinder 535 receives the sheet P conveyed by the drum 531 and forwards the sheet P to the reversing unit 560.

The transfer cylinder 534 includes a sheet gripper to grip the leading end of the sheet P conveyed from the pretreatment unit 520 to the printing unit 530. The sheet P thus gripped is conveyed as the transfer cylinder 534 rotates. The transfer cylinder 534 forwards the sheet P to the drum 531 at a position opposite the drum 531.

Similarly, the drum 531 includes a sheet gripper on the surface thereof, and the leading end of the sheet P is gripped by the sheet gripper. The drum 531 has a plurality of suction holes dispersedly on the surface thereof, and a suction device generates suction airflows directed inward from suction holes of the drum 531.

On the drum 531, the sheet gripper grips the leading end of the sheet P forwarded from the transfer cylinder 534, and the sheet P is attracted to and borne on the drum 531 by the suction airflows by the suction device. As the drum 531 rotates, the sheet P is conveyed.

The liquid discharge device 532 includes discharge units 533 (e.g., discharge units 533A to 533D) serving as liquid dischargers to discharge liquids. For example, the discharge unit 533A discharges a liquid of cyan (C), the discharge unit 533B discharges a liquid of magenta (M), the discharge unit 533C discharges a liquid of yellow (Y), and the discharge unit 533D discharges a liquid of black (K). In addition, a discharge unit to discharge a special liquid, that is, a liquid of spot color such as white, gold, or silver, can be used.

As illustrated in FIG. 2, for example, each of the discharge units 533 includes a head module 100 that includes a full-line head in which a plurality of liquid discharge heads 1 (hereinafter simply referred to as "heads 1") is arrayed in a staggered manner on a base member 103. Each of the heads 1 includes a plurality of nozzle rows. Each of the plurality of nozzle rows is an array of nozzles 11.

The discharge operation of each of the discharge units 533 of the liquid discharge device 532 is controlled by a drive signal corresponding to print data. When the sheet P borne on the drum 531 passes through a region facing the liquid discharge device 532, the respective color liquids are discharged from the discharge units 533, and an image corresponding to the print data is formed.

The reversing unit 560 reverses the sheet P in switchback manner when double-sided printing is performed on the sheet P transferred from the transfer cylinder 535. The reversed sheet P is fed back to the upstream side of the transfer cylinder 534 through a conveyance passage 561 of the printing unit 530.

The drying unit 540 dries the liquid applied onto the sheet P by the printing unit 530. As a result, a liquid component such as moisture in the liquid evaporates, and the colorant contained in the liquid is fixed on the sheet P. Additionally, curling of the sheet P is restrained.

The unloading unit 550 includes an unloading tray 551 on which a plurality of sheets P is stacked. The plurality of sheets P conveyed from the drying unit 540 are sequentially stacked and held on the unloading tray 551.

In the present embodiment, an example in which the sheet is a cut sheet is described. However, embodiments of the present disclosure can also be applied to an apparatus using a continuous medium (web) such as continuous paper or roll paper, an apparatus using a sheet material such as wallpaper, and the like.

Figure 3:
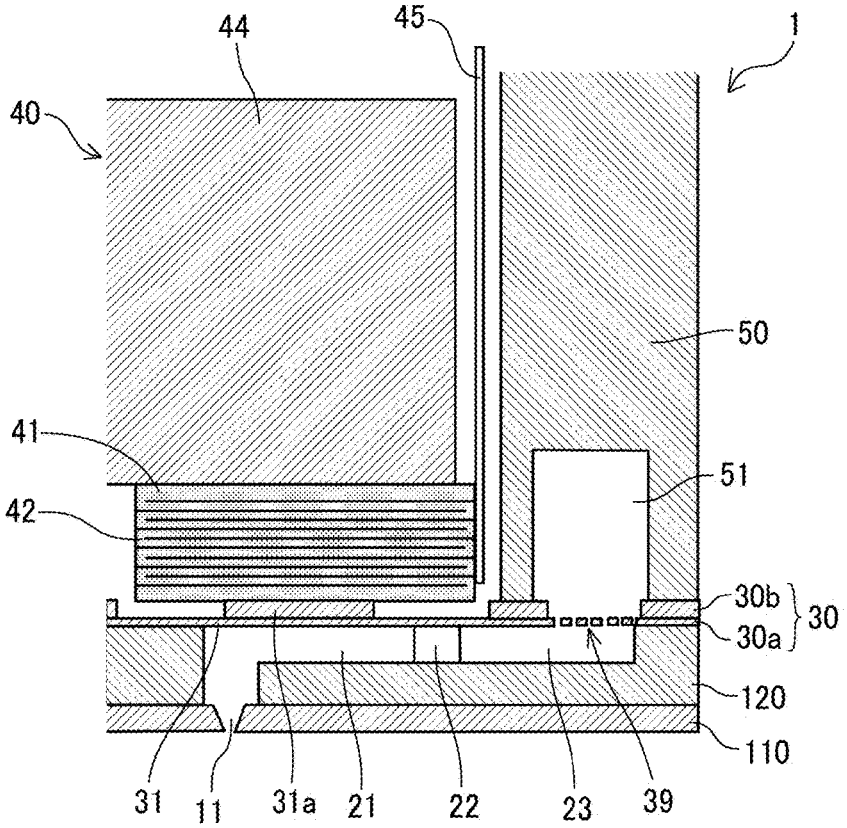
FIG. 3 is a cross-sectional view of an example of a liquid discharge head (also simply referred to as head) taken along a direction orthogonal to a nozzle array direction of the head.
Figure 4:
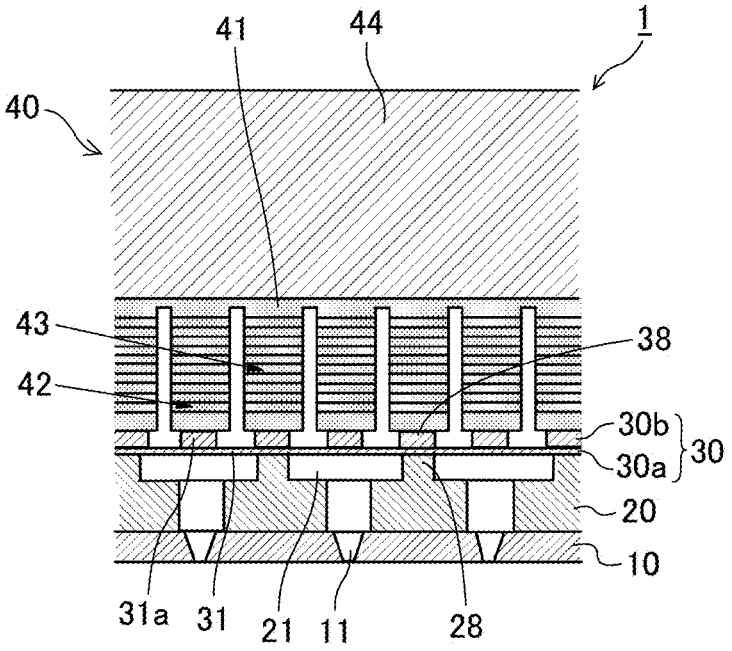
FIG. 4 is a cross-sectional view of the head taken along the nozzle array direction.

Next, an example of the head is described with reference to FIGS. 3 and 4. FIG. 3 is a cross sectional view of the liquid discharge head, taken along a direction perpendicular to a nozzle array direction. FIG. 4 is a cross sectional view of the liquid discharge head, taken along the nozzle array direction.

In the head 1 of the present embodiment, a nozzle plate 10, a channel plate 20, and a diaphragm substrate 30 as a wall member are laminated and bonded one on another. The head 1 further includes a piezoelectric actuator 40 to displace a vibration region (in other words, diaphragm region or diaphragm) 31 of the diaphragm substrate 30 and a common channel substrate 50 that also serves as a frame substrate of the liquid discharge head.

The nozzle plate 10 has a nozzle row in which a plurality of nozzles 11 are arranged.

The channel plate 20 forms a plurality of pressure chambers 21 communicated with the plurality of nozzles 11, a plurality of individual supply channels 22 that also serve as fluid restrictors communicated with the respective pressure chambers 21, and one or more intermediate supply channels 23 communicated with one or more of the plurality of individual supply channels 22. Adjacent ones of the pressure chambers 21 and 21 are separated by a partition wall 28.

The diaphragm substrate 30 has a plurality of displaceable vibration regions 31 that form wall surfaces of the pressure chambers 21 of the channel plate 20. Here, the diaphragm substrate 30 has a two-layer structure and includes a first layer 30*a* forming a thin portion and a second layer 30*b* forming a thick portion in this order from a side facing the channel plate 20. Note that the structure of the diaphragm substrate is not limited to such a two-layer structure but may be any suitable layer structure.

The displaceable vibration region 31 is formed in a portion corresponding to the pressure chamber 21 in the first layer 30*a* that is a thin portion. The vibration region 31 includes an island-shaped convex portion 31*a* that is a thick portion bonded to the piezoelectric actuator 40 in the second layer 30*b*. In addition, a bonding portion 38, which is a thick portion, is formed of the second layer 30*b* in a portion of the diaphragm substrate 30 corresponding to the partition wall 28 between the pressure chambers 21.

The piezoelectric actuator 40 including an electromechanical transducer element serving as a pressure generating element (in other words, a driving device or an actuator device) to deform the vibration region 31 of the diaphragm substrate 30 is disposed on a side of the diaphragm substrate 30 opposite a side facing the pressure chamber 21.

In the piezoelectric actuator 40, a piezoelectric member 41 bonded on a base 44 is grooved by half-cut dicing, to form a desired number of columnar piezoelectric elements 42 and support portions 43 at predetermined intervals in a comb shape.

The piezoelectric element 42 is a piezoelectric element that is applied with a drive voltage to displace the vibration region 31. The support portion 43 is a piezoelectric element that supports the partition wall 28 between the pressure chambers 21 and is not applied with a drive voltage.

The piezoelectric element 42 is bonded to an island-shaped convex portion 31*a* with an adhesive. The convex portion 31*a* is a thick portion in the vibration region 31 of the diaphragm substrate 30. The support portion 43 is bonded with an adhesive to the bonding portion 38 that is a thick portion disposed at a portion corresponding to the partition wall 28 of the diaphragm substrate 30.

The piezoelectric member 41 includes piezoelectric layers and internal electrodes alternately laminated on each other. Each internal electrode is led out to an end surface and connected to an external electrode (end surface electrode). The external electrode is connected with a flexible wiring member 45.

The common channel substrate 50 forms a common supply channel 51. The common supply channel 51 communicates with an intermediate supply channel 23 via a filter 39 provided in the diaphragm substrate 30.

In the head 1, for example, the voltage to be applied to the piezoelectric element 42 is lowered from a reference potential (intermediate potential) so that the piezoelectric element 42 contracts to pull the vibration region 31 of the diaphragm substrate 30. Accordingly, the volume of the pressure chamber 21 is increased to flow liquid into the pressure chamber 21.

Then, the voltage to be applied to the piezoelectric element 42 is increased to expand the piezoelectric element 42 in a direction of lamination. The vibration region 31 of the diaphragm substrate 30 is deformed in a direction toward the nozzle 11 to reduce the volume of the pressure chamber 21. As a result, the liquid in the pressure chamber 21 is pressurized and discharged from the nozzle 11.

Figure 5:
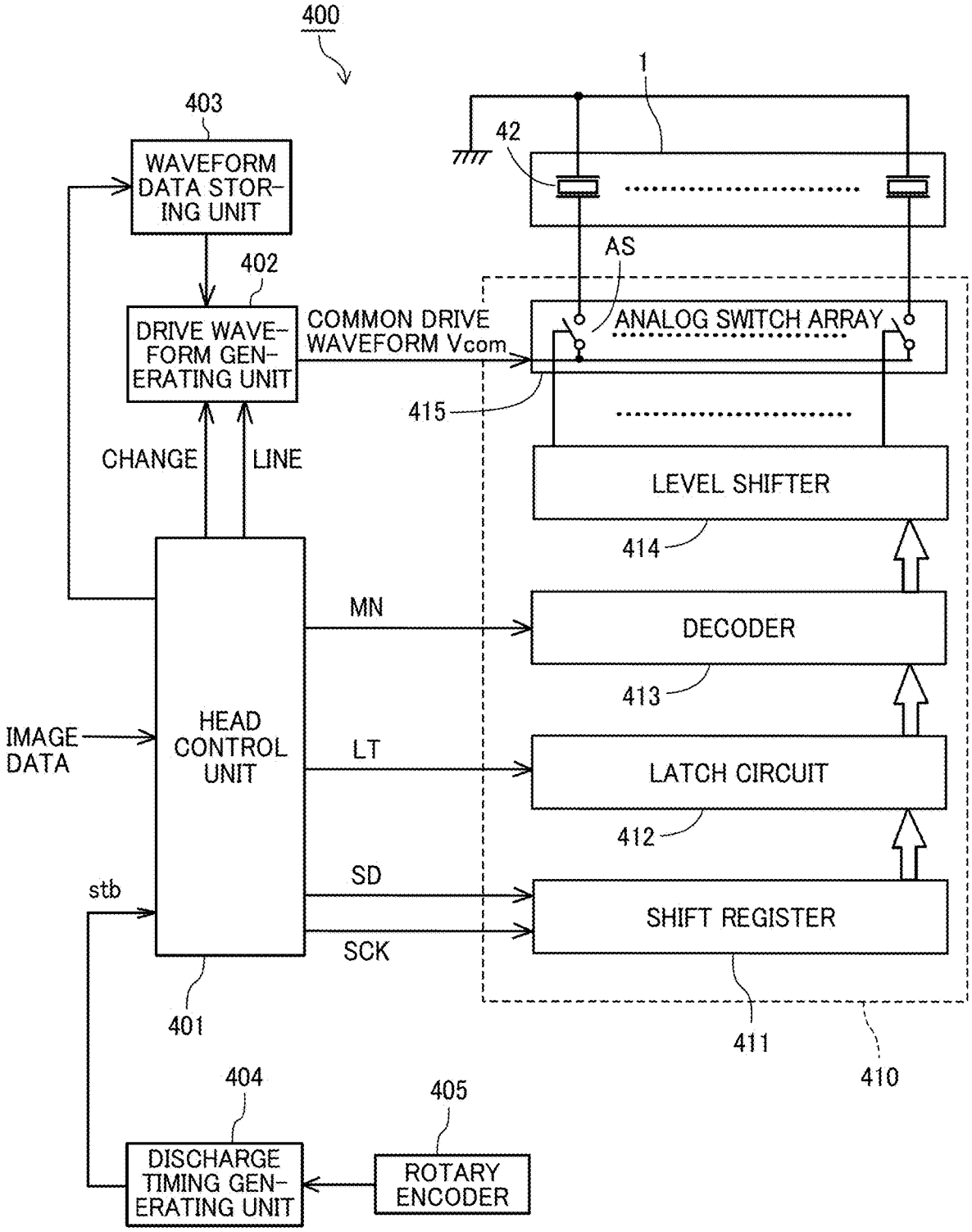
FIG. 5 is a block diagram of a head drive controller of the printer.

Next, a section related to a head drive control device that controls the driving of the head is described with reference to a block diagram of FIG. 5.

The head drive control device 400 includes a head controller 401, a drive waveform generating unit 402 and a waveform data storage unit 403 that constitute a drive waveform generator, a head driver 410, and a discharge timing generation unit 404 to generate a discharge timing.

In response to a reception of a discharge timing pulse stb, the head controller 401 outputs a discharge synchronization signal LINE that triggers generation of a common drive waveform, to the drive waveform generating unit 402. The head controller 401 outputs a discharge timing signal CHANGE corresponding to the amount of delay from the discharge synchronization signal LINE, to the drive waveform generating unit 402.

The drive waveform generating unit 402 generates and outputs a common drive waveform Vcom at the timing based on the discharge synchronization signal LINE and the discharge timing signal CHANGE.

The head controller 401 also serves as a unit that outputs a selection signal for designating a waveform portion to be selected by a selection unit constituted by an analog switch AS of the head driver 410.

The head controller 401 receives image data and generates a selection signal MN for selecting a predetermined required waveform portion of the common drive waveform Vcom for each nozzle 11 according to the size of liquid to be discharged from each nozzle 11 of the head 1 and the characteristic variation of the nozzle 11 based on the image data. Accordingly, the selection signals MN are output by the number of nozzles 11. The selection signal MN is a signal at a timing synchronized with the discharge timing signal CHANGE.

The head controller 401 transmits image data SD, a synchronization clock signal SCK, a latch signal LT instructing latch of the image data, and the generated selection signal MN to the head driver 410.

The head driver 410 is a selection unit that selects a waveform portion to be applied to each pressure generating element (piezoelectric element 42) of the head 1 in the common drive waveform Vcom, based on various signals from the head controller 401.

The head driver 410 includes a shift register 411, a latch circuit 412, a gradation decoder 413, a level shifter 414, and an analog switch array 415.

The shift register 411 receives the image data SD and the synchronization clock signal SCK transmitted from the head controller 401. The latch circuit 412 latches each resister value of the shift register 411 by the latch signal LT transmitted from the head controller 401.

The gradation decoder 413 decodes the value (image data SD) latched by the latch circuit 412 and the selection signal MN for each nozzle 11 and outputs the result. The level shifter 414 performs level conversion of a logic level voltage signal of the gradation decoder 413 to a level at which the analog switch AS of the analog switch array 415 can operate.

The analog switch AS of the analog switch array 415 is a switch that is turned on and off according to the output of the gradation decoder 413 supplied via the level shifter 414 and switches passing and non-passing (blocking) of the common drive waveform Vcom.

The analog switch AS is provided for each nozzle 11 of the head 1 and is connected to an individual electrode of the piezoelectric element 42 corresponding to each nozzle 11. In addition, the common drive waveform Vcom from the drive waveform generating unit 402 is input to the analog switch AS. As described above, the timing of the selection signal MN is synchronized with the timing of the common drive waveform Vcom.

Therefore, the analog switch AS is switched between on and off timely in accordance with the output from the gradation decoder 413 via the level shifter 414. With this operation, a waveform portion to be applied to the piezoelectric element 42 corresponding to each nozzle 11 is selected from the common drive waveform Vcom. As a result, the size of droplet discharged from the nozzle 11 is controlled.

The discharge timing generation unit 404 generates and outputs the discharge timing pulse stb each time the sheet P is moved by a predetermined amount, based on the detection result of a rotary encoder 405 that detects the rotation amount of the drum 531. The rotary encoder 405 includes an encoder wheel that rotates together with the drum 531 and an encoder sensor that reads a slit of the encoder wheel.

Figure 6A:
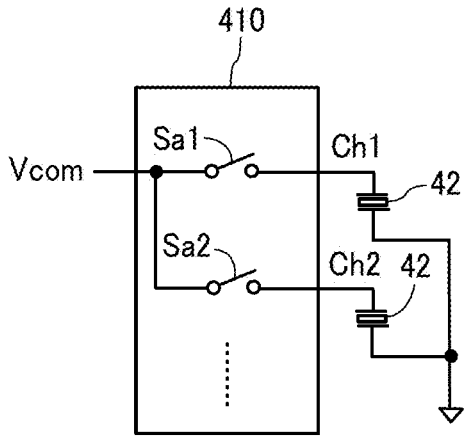
FIGS. 6A and 6B are illustrations of different examples of a portion of a head driver that selects a common drive waveform.
Figure 6B:
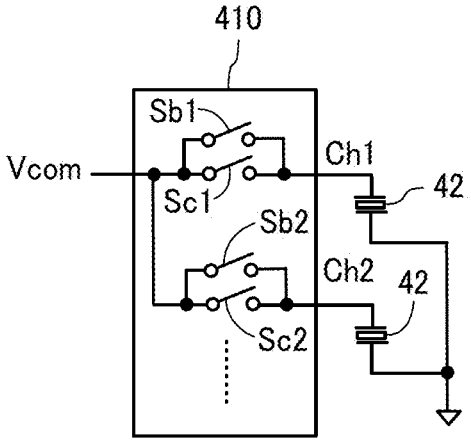

Next, with reference to FIGS. 6A and 6B, a description is given of different examples of a portion of the head driver that selects the common drive waveform. FIGS. 6A and 6B are illustrations of examples of a switch portion of the head driver.

In a first example of FIG. 6A, drive waveforms are applied to the piezoelectric elements 42 via selection switches Sa (Sa1, Sa2, . . . ) to which the common drive waveform Vcom is input.

By turning on and off the selection switches Sa according to the selection signal MN, required waveform portions of the common drive waveform Vcom are cut out and applied to the piezoelectric elements 42 as application waveforms.

In a second example of FIG. 6B, drive waveforms are applied to the piezoelectric elements 42 via parallel circuits of droplet amount switches Sb (Sb1, Sb2, . . . ) and trimming selection switches Sc (Sc1, Sc2, . . . ) to which the common drive waveform Vcom is input.

The droplet amount switch Sb is turned on and off according to the droplet amount (e.g., large droplet, medium droplet, or small droplet).

By turning on and off the trimming selection switches Sc according to the selection signal MN, required waveform portions of the common drive waveform Vcom are cut out and applied to the piezoelectric elements 42 as application waveforms.

Figure 7:
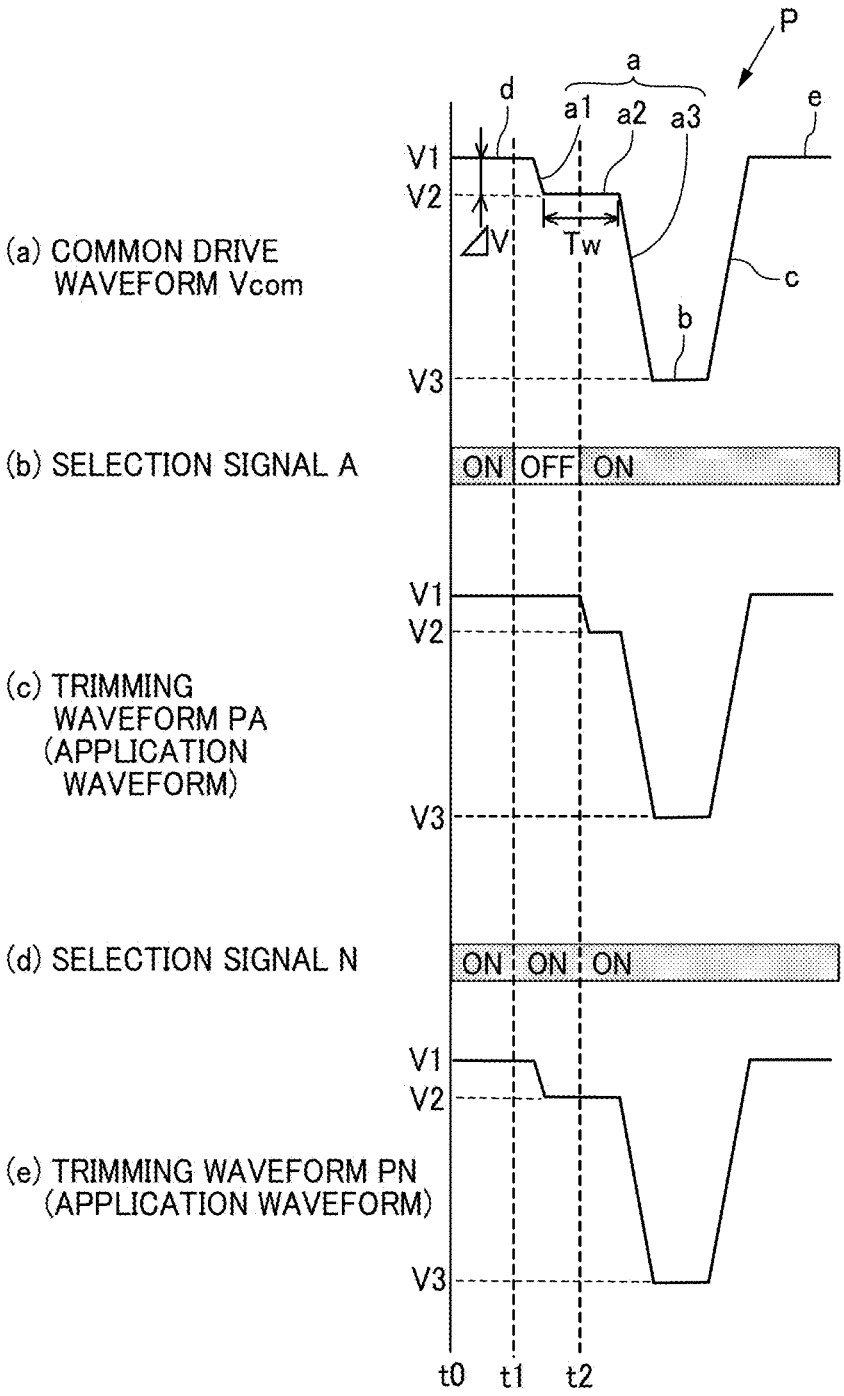
FIG. 7 is a graph illustrating drive waveforms and selection signals in the first embodiment of the present disclosure.

Next, drive waveforms and selection signals in a first embodiment of the present disclosure are described with reference to FIG. 7. FIG. 7 is a diagram illustrating a common drive waveform, a selection signal, and an application waveform (trimming waveform) applied to a pressure generating element in the first embodiment.

As illustrated in FIG. 7A, the common drive waveform Vcom of the present embodiment includes a drive pulse P as a discharge pulse for pressurizing the pressure chamber 21 to discharge liquid. In this example, the drive pulse P is a pulse for discharging, for example, a small droplet. However, the size of the pulse discharged by the drive pulse P is not limited to the small pulse, and the same applies to the following embodiments.

The drive pulse P includes an expansion waveform element a for expanding the pressure chamber 21, a holding waveform element b for holding an expansion state of the pressure chamber 21 expanded by the expansion waveform element a, and a contraction waveform element c for contracting the pressure chamber 21 from the expansion state held by the holding waveform element b to discharge liquid.

In the present embodiment, the expansion waveform element a is a waveform that performs two-stage expansion. The expansion waveform element a includes a first-stage expansion waveform element a1 for expanding the pressure chamber 21, a first-stage holding waveform element a2 for holding the state expanded by the first-stage expansion waveform element a1, and a second-stage expansion waveform element a3 for further expanding the pressure chamber 21 from the state held by the first-stage holding waveform element a2.

The first-stage expansion waveform element a1 falls to a potential V2 (V1<V2) of a potential difference ΔV from the intermediate potential (or reference potential) V1. The first-stage holding waveform element a2 holds the potential V2. The second-stage expansion waveform element a3 falls from the potential V2 to a potential V3 (V3<V2).

The holding waveform element b holds the potential V3 that is a terminal potential of the second-stage expansion waveform element a3. That is, in the present embodiment, the second-stage expansion waveform element a3 is an expansion waveform element having, as a terminal, the state (potential) held by the holding waveform element b.

The contraction waveform element c rises from the held potential V3 to the intermediate potential V1.

On the other hand, as illustrated in part (b) and (d) of FIG. 7, the selection signals MN for selecting the drive pulse P output from the head controller 401 include a plurality of types (here, two types) of selection signals A and N. The head controller 401 outputs one of the selection signals A and N predetermined for each nozzle 11 as the selection signal MN.

In the present embodiment, when the selection signals A and N are "ON", the analog switch AS is turned on (ON state), and the common drive waveform Vcom passes through the analog switch AS. When the selection signals A and N are "OFF", the analog switch AS is turned off (OFF state), and the common drive waveform Vcom does not pass through the analog switch AS (non-passage state). In other words, a waveform portion selected by the analog switch AS (selection unit) is designated by setting the selection signals A and N to "ON". Note that the selection signals A and N are, for example, two-valued signals that are turned "OFF" when the selection signals A and N are "H" and turned "OFF" when the selection signals A and N are "L". However, in FIG. 7, the selection signals A and N are represented by "ON" and "OFF" of the analog switch AS.

As illustrated in part (b) of FIG. 7, the selection signal A is "ON" from time point t0, transitions from "ON" to "OFF" in the middle of the intermediate-potential holding waveform element d (time point t1), and transitions from "OFF" to "ON" in the middle of the first-stage holding waveform element a2 (time point t2).

In other words, the selection signal A deselects a part of the waveform portion preceding the middle of the first-stage holding waveform element a2, which is a waveform portion preceding the second-stage expansion waveform element a3 having the state (potential V3) held by the holding waveform element b as the terminal.

In this way, when the selection signal A transitions from "ON" to "OFF" in the middle of the intermediate-potential holding waveform element d and the common drive waveform Vcom does not pass, the voltage applied to the piezoelectric element 42 is held at the potential (intermediate potential) V1 at that time. When the selection signal A transitions from "OFF" to "ON", the potential of the selection signal A falls to the potential V2 of the first-stage holding waveform element a2, which is the potential at the time of the transition.

Accordingly, when the selection signal A is output, as illustrated in part (c) of FIG. 7, the intermediate-potential holding waveform element d extends to the time point t2, and the trimming waveform PB in which the first-stage expansion waveform element a1 starts from the time point t2 is applied to the piezoelectric element 42 as the application waveform.

In such a case, the time point t2 at which the selection signal A is turned ON can be set to an optimum timing for each nozzle 11 in the period Tw of the first-stage holding waveform element a2. Thus, a trimming waveform corresponding to a necessary correction amount can be applied as an application waveform to each nozzle 11.

At this time, trimming is performed using the waveform portion of the intermediate potential V1 immediately before the drive pulse P of the common drive waveform Vcom, thus allowing correction of the variation in the discharge characteristics even for a head having a short natural cycle.

On the other hand, as illustrated in part (d) of FIG. 7, the selection signal N is "ON" from the time point t0 and does not transit "OFF". In other words, the selection signal N instructs the analog switch AS as the selection unit to select all of the drive pulse P. Accordingly, when the selection signal N is output, all of the drive pulse P pass through, and the common drive waveform Vcom is directly applied to the piezoelectric element 42 as the application waveform PN.

Hence, the application waveform PN selected by the selection signal N or the application waveform PA selected by the selection signal A are applied in accordance with the discharge characteristics of the nozzle 11, thus allowing the variation in the discharge characteristics to be reduced. Note that, as described above, two or more selection signals having different time points t2 at which the selection signal A is turned on can be used. In such a case, the selection signal N may not be used.

Figure 8:
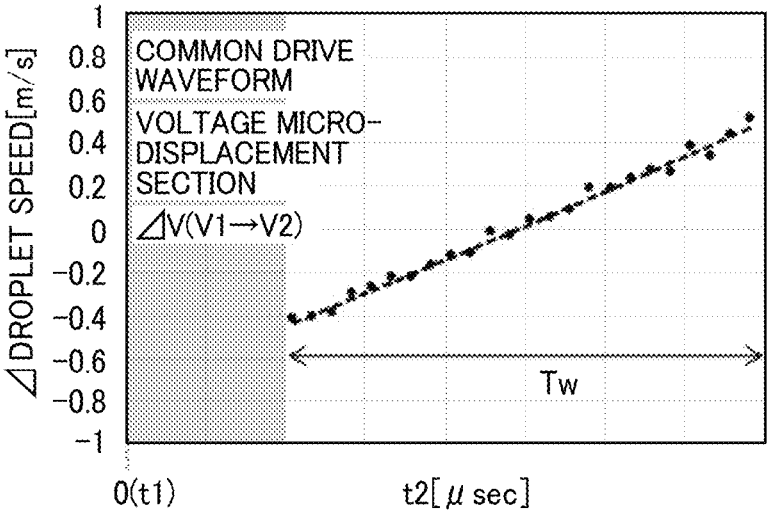
FIG. 8 is a graph illustrating an example of the amount of change in discharge speed (droplet speed) when trimming is performed with a selection signal in the first embodiment.

Next, an example of the amount of change in the discharge speed (droplet speed) when trimming is performed with the selection signal A is described with reference to FIG. 8. FIG. 8 is a graph illustrating an example of the amount of change in the discharge speed (Δ droplet speed) when the time point t2 at which the selection signal A transitions from "OFF" to "ON" is changed to change the period Tw of the first-stage holding waveform element a2.

In FIG. 8, the horizontal axis represents the time point t2 with the time point t1, at which the selection signal A in FIG. 7 transitions from "ON" to "OFF", being zero. The period Tw of the first-stage holding waveform element a2 of the drive pulse P of the common drive waveform Vcom is set to ½ of the natural vibration cycle of the pressure chamber 21. However, the length of the period Tw may not necessarily be ½ of the natural vibration cycle of the pressure chamber 21 and may be longer or shorter than ½ of the natural vibration cycle of the pressure chamber 21. Preferably, the length of the period Tw is about ½ to the same length of the natural vibration cycle of the pressure chamber 21.

Here, as the time point t2 is earlier, the time during which the selection signal A is "ON" is shorter and the period Tw of the first-stage holding waveform element a2 is longer. As the period Tw of the first-stage holding waveform element a2 is longer, the discharge speed is slower and the change amount of the droplet speed (A droplet speed) is larger to the minus side.

On the other hand, as the time point t2 is delayed, the time during which the selection signal A is "ON" is longer and the period Tw of the first-stage holding waveform element a2 is shorter. As the period Tw of the first-stage holding waveform element a2 is shorter, the discharge speed is faster and the change amount of the droplet speed (A droplet speed) is larger to the plus side.

Thus, changing the timing (time point t2) at which the selection signal A transitions from "OFF" to "ON" allows the discharge speed to be changed. Therefore, providing the selection signal A having the time point t2 corresponding to the characteristic of the discharge speed of the nozzle 11 allows the variation of the discharge speed to be reduced.

Figure 9:
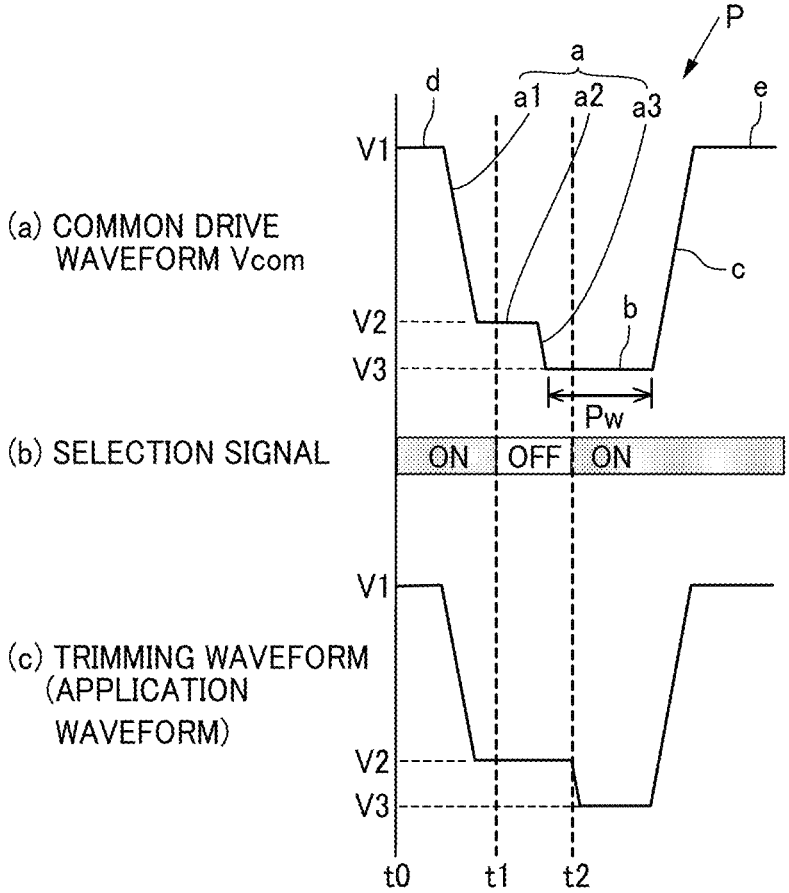
FIG. 9 is a graph illustrating drive waveforms and a selection signal in Comparative Example 1.

Here, Comparative Example 1 is described with reference to FIG. 9. FIG. 9 is a graph illustrating a common drive waveform, a selection signal, and an application waveform (trimming waveform) applied to a pressure generating element in Comparative Example 1.

In Comparative Example 1, as illustrated in part (b) of FIG. 9, the selection signal transitions from "ON" to "OFF" in the middle of the first-stage holding waveform element a2 of the expansion waveform element a, and transitions from "OFF" to "ON" in the middle of the holding waveform element b.

Thus, the drive pulse P of the common drive waveform Vcom illustrated in part (a) of FIG. 9 is trimmed, and a trimming waveform (application waveform) in which the width Pw of the holding waveform element b has been changed is obtained as illustrated in part (c) of FIG. 9.

As the printing speed of a line printer or the like increases, the natural cycle of the head tends to be shortened in order to drive the head at high speed. In addition, in the case where the discharged droplets are made into fine droplets for the purpose of improving image quality, the natural cycle of the head tends to be shortened.

In the case in which trimming as in Comparative Example 1 is performed on such a head having a short natural cycle, a sufficient time cannot be taken for the period (width Pw) of the holding waveform element b if the time required for switching and the time required for voltage displacement are subtracted.

For example, in the case of a head having a natural cycle of about 3 pec (microseconds), the time from the start of the expansion waveform element a to the end of the contraction waveform element c is only about 1.5 to 2.5 μsec. Accordingly, the time that can be used for the width Pw hardly remains and the variation in the discharge characteristics cannot be corrected.

On the other hand, in the present embodiment, the trimming is not performed on the holding waveform element b that holds the most expanded state. Accordingly, the variation in the discharge characteristics can be reduced by performing the trimming even on a head having a short natural cycle.

Figures 10, 11:
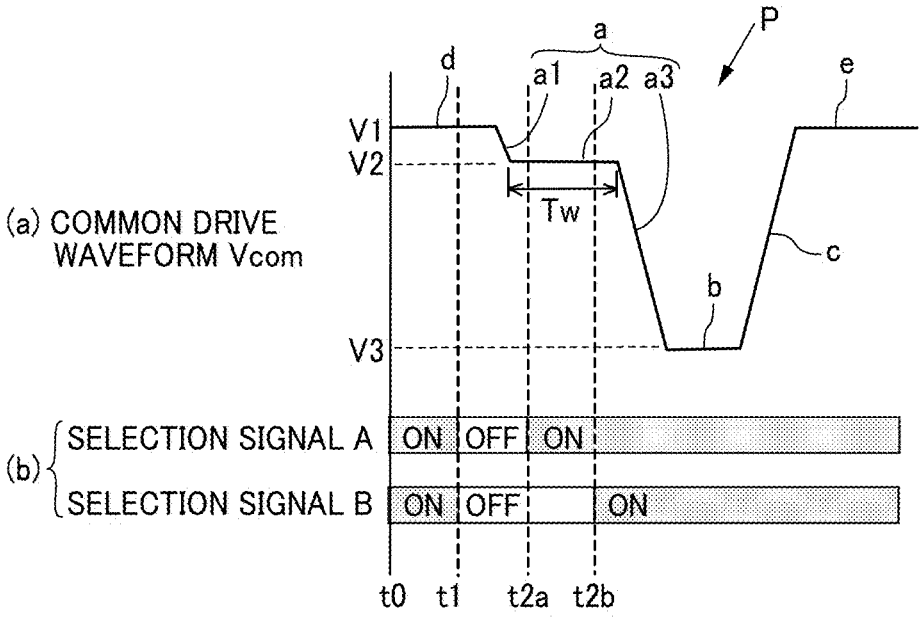
FIG. 10 is a graph illustrating a drive waveform and selection signals in a second embodiment of the present disclosure.
FIG. 11 is a table of an example of the relationship between two nozzles and selection signals in an operation of the second embodiment.

Next, a second embodiment of the present disclosure is described with reference to FIG. 10. FIG. 10 is a graph illustrating a common drive waveform and selection signals in the second embodiment.

In the present embodiment, the configurations of a common drive waveform Vcom and a drive pulse P are the same as the common drive waveform Vcom and the drive pulse P in the first embodiment. The head controller 401 outputs a plurality of types (in this example, two types) of head selection signals A and B having different waveform portions to be selected for each nozzle 11.

The selection signal A is "ON" from time point t0, transitions from "ON" to "OFF" in the middle of the intermediate-potential holding waveform element d (time point t1), and transitions from "OFF" to "ON" in the middle of the first-stage holding waveform element a2 (time point t2*a*).

The selection signal B is "ON" from the time point t0, transitions from "ON" to "OFF" in the middle of the intermediate-potential holding waveform element d (time point t1), and transitions from "OFF" to "ON" in the middle of the first-stage holding waveform element a2 (time point t2*b* that is a time point later than the time point t2*a*).

In other words, any of the selection signal A and B deselects a part of the waveform portion preceding the middle of the first-stage holding waveform element a2, which is a waveform portion preceding the second-stage expansion waveform element a3 having the state (potential V3) held by the holding waveform element b as the terminal.

In such a case, the period Tw of the first-stage holding waveform element a2 in the selection signal B is shorter than the period Tw of the first-stage holding waveform element a2 in the selection signal A. Accordingly, as described with reference to FIG. 8, the discharge speed of the application waveform trimmed by the selection signal B is higher than the discharge speed of the application waveform trimmed by the selection signal A.

Figure 12:
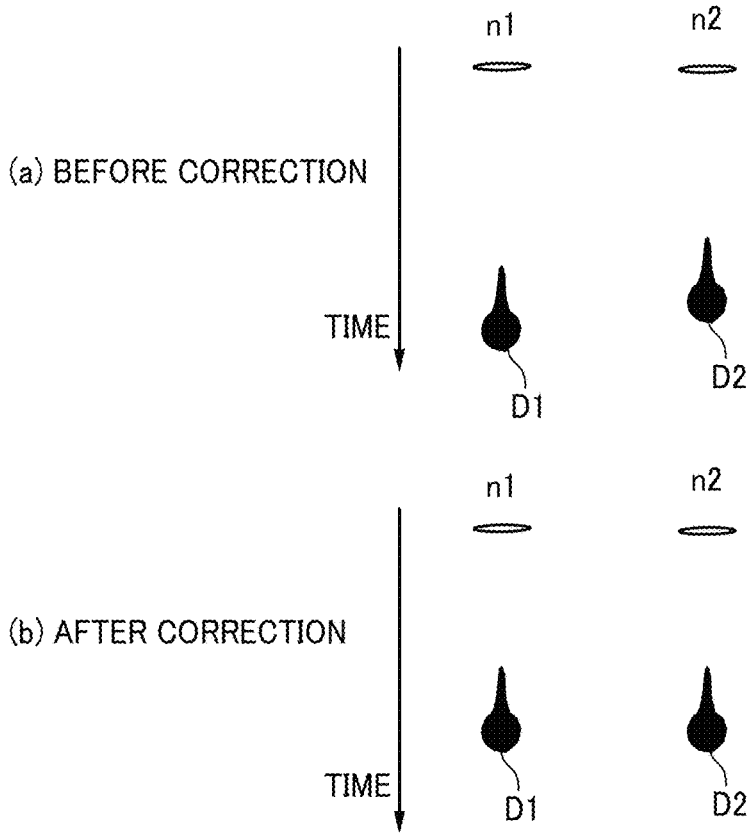
FIG. 12 is an illustration of discharge speeds before and after correction.

Next, an example of the operation of the present embodiment is described with reference to FIGS. 11 and 12. FIG. 11 is a table of an example of the relationship between two nozzles and selection signals. FIG. 12 is an illustration of discharge speeds before and after correction.

Here, as illustrated in FIG. 12, it is assumed that droplets D1 and D2 are discharged from two nozzles n1 and n2, respectively. When the same drive pulse P is applied to the two nozzles n1 and n2, as illustrated in part (a) of FIG. 12, the discharge speed of the droplet D1 of the nozzle n1 is faster than the discharge speed of the droplet D2 of the nozzle n2.

Hence, as illustrated in FIG. 11, selection signals A and B are assigned to the nozzles n1 and n2, respectively. An application waveform trimmed by the selection signal A is applied to the nozzle n1 having a characteristic of a relatively slow discharge speed, and an application waveform trimmed by the selection signal B is applied to the nozzle n2 having a characteristic of a relatively slow discharge speed.

Accordingly, as illustrated in part (b) of FIG. 12, the variation in the discharge speeds of the droplets D1 and D2 ejected from the nozzles n1 and n2, respectively, can be reduced, and the discharge speeds can be adjusted to be substantially the same (including the same) discharge speed.

In the present embodiment, the selection signal N (selection signal for selecting all of the drive pulse P) in the first embodiment is not described. However, the same selection signal N as the selection signal N in the first embodiment may be also used in the present embodiment.

Figure 13:
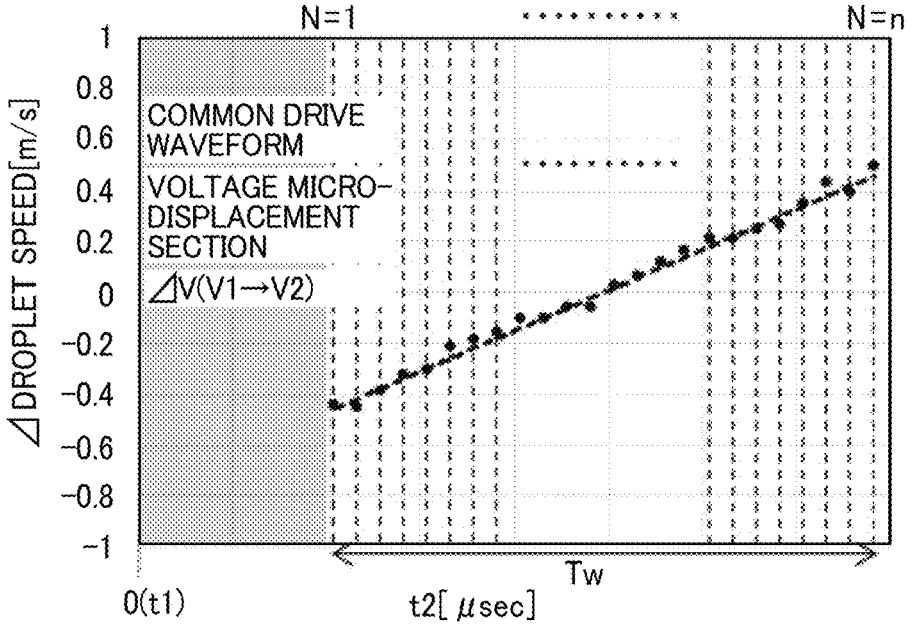
FIG. 13 is a graph illustrating correction by grouping in the second embodiment.

Next, correction by grouping in the present embodiment is described with reference to FIG. 13. FIG. 13 is a graph illustrating an example of grouping of the amount of change in the discharge speed (A droplet speed) and the period Tw obtained when the period Tw of the first-stage holding waveform element a2 is changed by changing the time point t2 at which the selection signal for performing trimming transitions from "OFF" to "ON".

Here, the plurality of nozzles 11 included in the head 1 are divided into a plurality of groups according to variations in discharge characteristics. On the other hand, as illustrated in FIG. 13, the period Tw of the first-stage holding waveform element a2 is divided into N, and N selection signals having different time points t2 at which each selection signal transitions from "OFF" to "ON" are set.

The period Tw (the timing at which the selection signal transitions from "OFF" to "ON") of the first-stage holding waveform element a2 is allocated. In period Tw, the correction amount of the discharge speed corresponding to the discharge characteristics of the group of each nozzle 11 is obtained.

Thus, variations in the discharge characteristics of all the nozzles 11 can be reduced.

Figure 14:
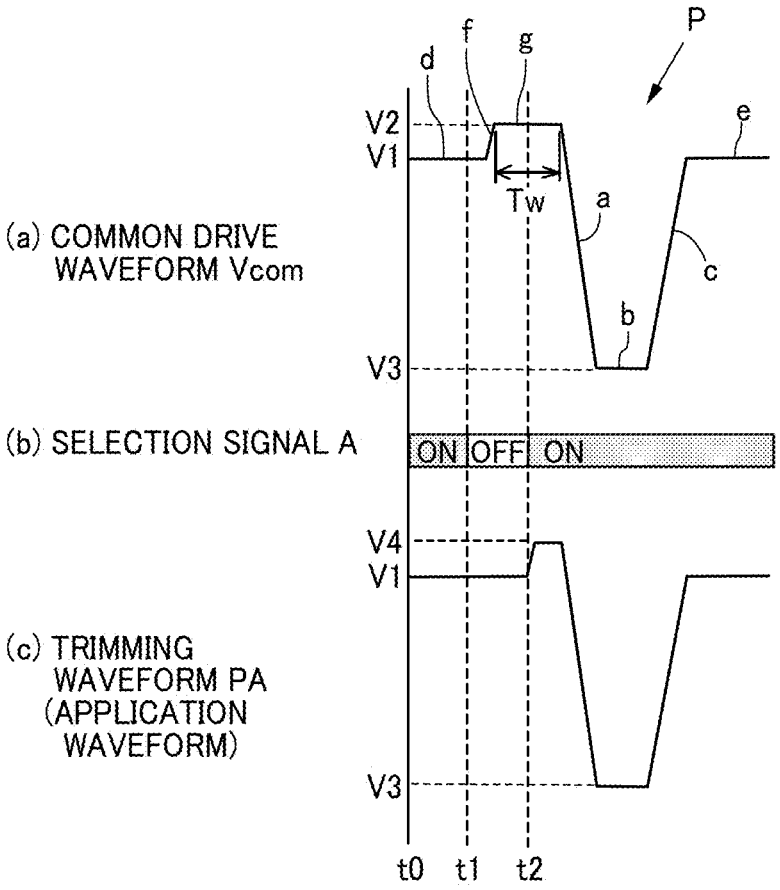
FIG. 14 is a graph illustrating drive waveforms and selection signals in a third embodiment of the present disclosure.

Next, a third embodiment of the present disclosure is described with reference to FIG. 14. FIG. 14 is a graph illustrating a common drive waveform, a selection signal, and an application waveform (trimming waveform) applied to a pressure generating element in the third embodiment.

As illustrated in part (a) of FIG. 14, the drive waveform Vcom of the present embodiment includes a drive pulse P as a discharge pulse for pressurizing the pressure chamber 21 to discharge liquid. The drive pulse P is a pulse for discharging, for example, a small droplet.

The drive pulse P includes an expansion waveform element a for expanding the pressure chamber 21, a holding waveform element b for holding an expansion state of the pressure chamber 21 expanded by the expansion waveform element a, and a contraction waveform element c for contracting the pressure chamber 21 from the expansion state held by the holding waveform element b to discharge liquid.

The drive pulse P includes, before the expansion waveform element a, a pre-contraction waveform element f for contracting the pressure chamber 21 and a pre-holding waveform element g for holding the state contracted by the pre-contraction waveform element f. The expansion waveform element a expands the pressure chamber 21 from the state held by the pre-holding waveform element g.

The pre-contraction waveform element f rises from an intermediate potential (or reference potential) V1 to a potential V2 (V2>V1). The pre-holding waveform element g holds the potential V2 that is a terminal potential of the pre-contraction waveform element f.

In the present embodiment, the expansion waveform element a is a waveform that performs one-stage expansion, and falls to a potential V3 from the potential V2 held by the pre-holding waveform element g as a start potential.

The holding waveform element b holds the potential V3 that is a terminal potential of the expansion waveform element a. In other words, in the present embodiment, the expansion waveform element a is an expansion waveform element having, as a terminal, the state (potential) held by the holding waveform element b.

The contraction waveform element c rises from the held potential V3 to the intermediate potential V1.

On the other hand, as illustrated in part (b) of FIG. 14, the head controller 401 outputs the selection signal A as the selection signal MN for selecting the drive pulse P. As in the first embodiment, the selection signal N for selecting all of the drive pulse P can also be output.

The selection signal A is "ON" from time point t0, transitions from "ON" to "OFF" in the middle of the intermediate-potential holding waveform element d (time point t1), and transitions from "OFF" to "ON" in the middle of the pre-holding waveform element g (time point t2).

In other words, the selection signal A deselects a part of the waveform portion preceding the middle of the pre-holding waveform element g, which is a waveform portion preceding the expansion waveform element a having, as a terminal, the state (potential V3) held by the holding waveform element b.

Therefore, when the selection signal A is output, as illustrated in part (c) of FIG. 14, the intermediate-potential holding waveform element d extends to the time point t2. The pre-contraction waveform element f starts from the time point t2 and rises to the potential V2. The trimming waveform PA in which the potential V2 is held by the pre-holding waveform element g is applied to the piezoelectric element 42 as the application waveform.

Here, by changing the time point t2 at which the selection signal A transitions from "OFF" to "ON", the duration of the period Tw of the pre-holding waveform element g changes, and the discharge speed changes.

Hence, the time point t2 at which the selection signal A transitions from "OFF" to "ON" can be set to an optimum timing for each nozzle 11. Thus, a trimming waveform corresponding to a necessary correction amount can be applied as an application waveform to each nozzle 11.

Figure 15:
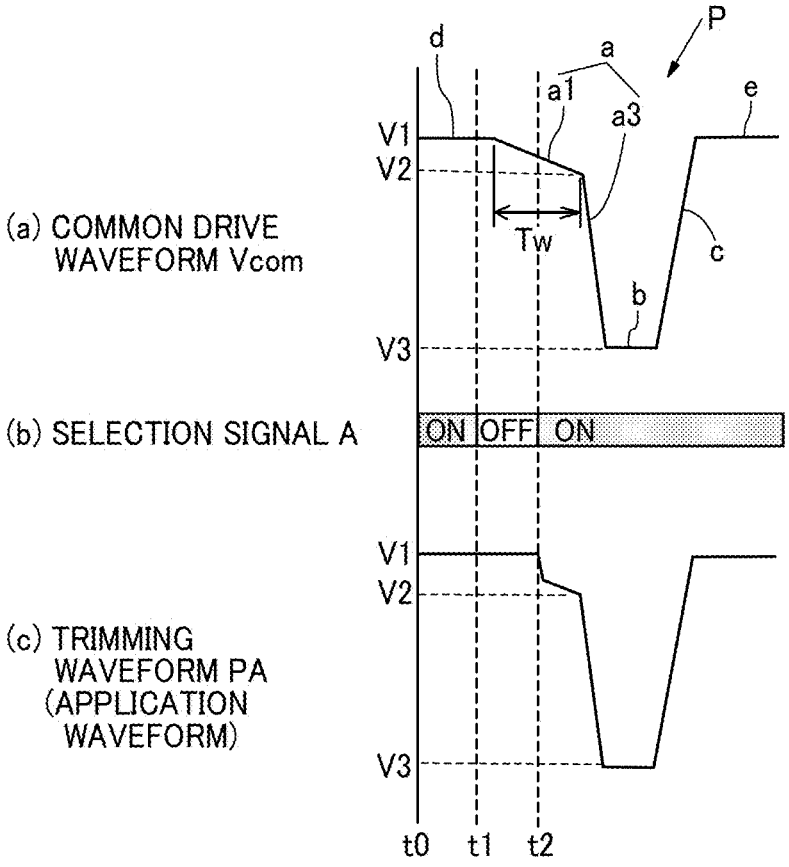
FIG. 15 is a graph illustrating drive waveforms and selection signals in a fourth embodiment of the present disclosure.

Next, a fourth embodiment of the present disclosure is described with reference to FIG. 15. FIG. 15 is a graph illustrating a common drive waveform, a selection signal, and an application waveform (trimming waveform) applied to a pressure generating element in the fourth embodiment.

As illustrated in part (a) of FIG. 15, the drive waveform Vcom of the present embodiment includes a drive pulse P as a discharge pulse for pressurizing the pressure chamber 21 to discharge liquid. The drive pulse P is a pulse for discharging, for example, a small droplet.

The drive pulse P includes an expansion waveform element a for expanding the pressure chamber 21, a holding waveform element b for holding an expansion state of the pressure chamber 21 expanded by the expansion waveform element a, and a contraction waveform element c for contracting the pressure chamber 21 from the expansion state held by the holding waveform element b to discharge liquid.

In the present embodiment, the expansion waveform element a includes a first-stage expansion waveform element a1 for expanding the pressure chamber 21 and a second-stage expansion waveform element a3 that is continuous with the first-stage expansion waveform element a1 and further expands the pressure chamber 21 from the state expanded by the first-stage expansion waveform element a1.

In other words, the waveform has no holding period corresponding to the first-stage holding waveform element a2 of the first embodiment.

The first-stage expansion waveform element a1 falls from the intermediate potential (or reference potential) V1 to the potential V2 (V1<V2). The second-stage expansion waveform element a3 falls from the potential V2 to a potential V3 (V3<V2).

The holding waveform element b holds the potential V3 that is a terminal potential of the expansion waveform element a. That is, in the present embodiment, the second-stage expansion waveform element a3 is an expansion waveform element having, as a terminal, the state (potential) held by the holding waveform element b.

The contraction waveform element c rises from the held potential V3 to the intermediate potential V1.

On the other hand, as illustrated in part (b) of FIG. 15, the head controller 401 outputs the selection signal A as the selection signal MN for selecting the drive pulse P. As in the first embodiment, the selection signal N for selecting all of the drive pulse P can also be output.

The selection signal A is "ON" from time point t0, transitions from "ON" to "OFF" in the middle of the intermediate-potential holding waveform element d (time point t1), and transitions from "OFF" to "ON" in the middle of the first-stage expansion waveform element a1 (time point t2).

In other words, the selection signal A deselects a part of the waveform portion preceding the middle of the first-stage expansion waveform element a1, which is a waveform portion preceding the second-stage expansion waveform element a3 having the state (potential V3) held by the holding waveform element b as the terminal.

Accordingly, when the selection signal A is output, as illustrated in part (c) of FIG. 15, a trimming waveform PA is applied to the piezoelectric element 42 as the application waveform. In the trimming waveform PA, the intermediate-potential holding waveform element d extends to the time point t2, falls from the time point t2 to the potential of the first-stage expansion waveform element a1, and starts the voltage change of the first-stage expansion waveform element a1.

Here, by changing the time point t2 at which the selection signal A transitions from "OFF" to "ON", the duration of the period Tw of the pre-holding waveform element g changes, and the discharge speed changes.

Hence, the time point t2 at which the selection signal A transitions from "OFF" to "ON" can be set to an optimum timing for each nozzle 11. Thus, a trimming waveform corresponding to a necessary correction amount can be applied as an application waveform to each nozzle 11.

Figure 16:
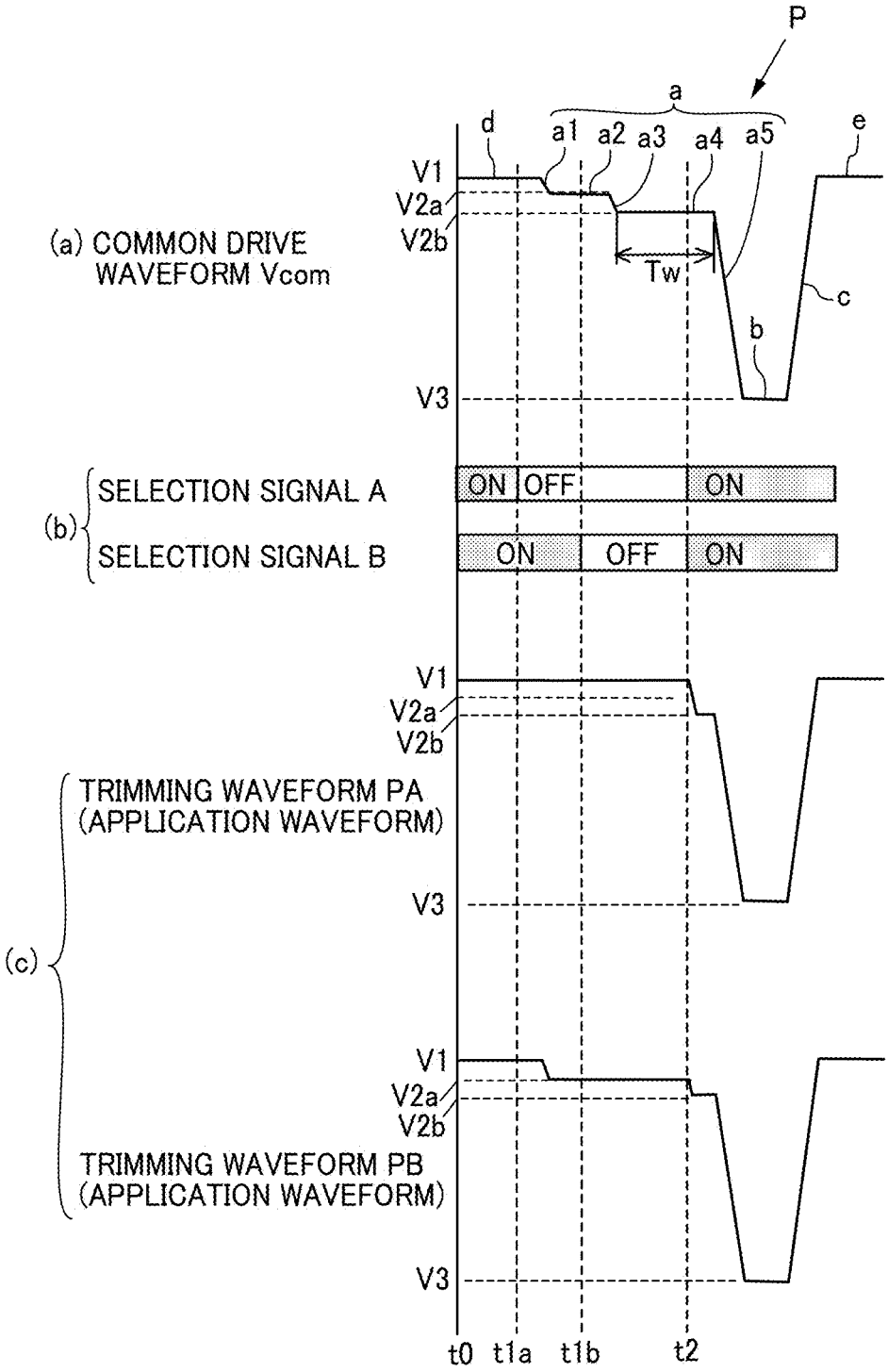
FIG. 16 is a graph illustrating drive waveforms and selection signals in a fifth embodiment of the present disclosure.

Next, a fifth embodiment of the present disclosure is described with reference to FIG. 16. FIG. 16 is a graph illustrating a common drive waveform, a selection signal, and an application waveform (trimming waveform) applied to a pressure generating element in the fifth embodiment.

As illustrated in part (a) of FIG. 16, the drive waveform Vcom of the present embodiment includes a drive pulse P as a discharge pulse for pressurizing the pressure chamber 21 to discharge liquid. The drive pulse P is a pulse for discharging, for example, a small droplet.

The drive pulse P includes an expansion waveform element a for expanding the pressure chamber 21, a holding waveform element b for holding an expansion state of the pressure chamber 21 expanded by the expansion waveform element a, and a contraction waveform element c for contracting the pressure chamber 21 from the expansion state held by the holding waveform element b to discharge liquid.

In the present embodiment, the expansion waveform element a is a waveform that performs three-stage expansion. The expansion waveform element a includes a first-stage expansion waveform element a1 for expanding the pressure chamber 21, a first-stage holding waveform element a2 for holding the state expanded by the first-stage expansion waveform element a1, a second-stage expansion waveform element a3 for expanding the pressure chamber 21 from the state held by the first-stage holding waveform element a2, a second-stage holding waveform element a4 for holding the state expanded by the second-stage holding waveform element a3, and a third-stage expansion waveform element a5 for expanding the pressure chamber 21 from the state held by the second-stage holding waveform element a4.

The first-stage expansion waveform element a1 falls from an intermediate potential (or reference potential) V1 to a potential V2*a* (V1<V2*a*). The first-stage holding waveform element a2 holds the potential V2*a*. The second-stage expansion waveform element a3 falls from the potential V2*a* to a potential V2*b* (V2*b*<V2*a*). The second-stage holding waveform element a4 holds the potential V2*b*. The third-stage expansion waveform element a5 falls from the potential V2*b* to a potential V3.

The holding waveform element b holds the potential V3 that is a terminal potential of the third-stage expansion waveform element a5. That is, in the present embodiment, the third-stage expansion waveform element a5 is an expansion waveform element having, as a terminal, the state (potential) held by the holding waveform element b.

The contraction waveform element c rises from the held potential V3 to the intermediate potential V1.

On the other hand, as illustrated in part (b) of FIG. 16, the head controller 401 outputs the selection signal A or B as the selection signal MN for selecting the drive pulse P. As in the first embodiment, the selection signal N for selecting all of the drive pulse P can also be output.

The selection signal A is "ON" from time point t0, transitions from "ON" to "OFF" in the middle of the intermediate-potential holding waveform element d (time point t1*a*), and transitions from "OFF" to "ON" in the middle of the second-stage holding waveform element a4 (time point t2).

The selection signal B is "ON" from time point t0, transitions from "ON" to "OFF" in the middle of the first-stage holding waveform element a2 (time point t1*b*), and transitions from "OFF" to "ON" in the middle of the second-stage holding waveform element a4 (time point t2).

In other words, the selection signals A and B deselect a part of the waveform portion preceding the middle of the second-stage holding waveform element a4, which is a waveform portion preceding the third-stage expansion waveform element a5 having the state (potential V3) held by the holding waveform element b as the terminal.

Accordingly, when the selection signal A is output, as illustrated in part (c) of FIG. 16, a trimming waveform PA in which the intermediate-potential holding waveform element d extends to the time point t2 and falls from the time point t2 to the potential V2*b* of the second-stage holding waveform element a4 is applied to the piezoelectric element 42 as the application waveform. The trimming waveform PA does not include the first-stage expansion waveform element a1.

When the selection signal B is output, as illustrated in part (c) of FIG. 16, a trimming waveform PB in which the potential V2*a* held by the first-stage holding waveform element a2 extends to the time point t2 and falls from the time point t2 to the potential V2*b* of the second-stage holding waveform element a4 is applied to the piezoelectric element 42 as the application waveform.

Figure 17:
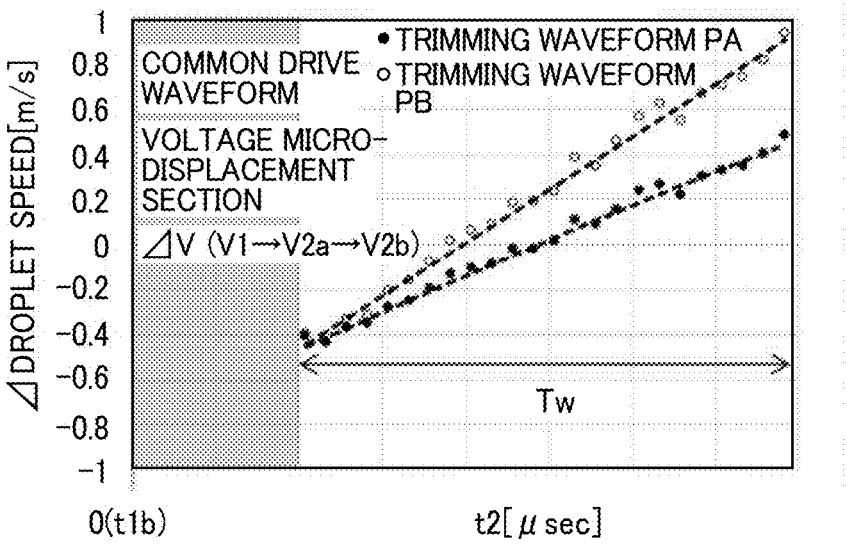
FIG. 17 is a graph illustrating an example of the correction amount of the discharge speed by the trimming waveforms PA and PB in the fifth embodiment.

Next, the correction amount of the discharge speed by the trimming waveforms PA and PB of the present embodiment is described with reference to FIG. 17. FIG. 17 is a graph illustrating an example of the correction amount (A droplet speed) of the discharge speed by the trimming waveforms PA and PB.

In FIG. 17, the horizontal axis represents the time point t2 with the time point t1*b* in FIG. 16 being zero. The time point t2 has a correction range of the period Tw of the second-stage holding waveform element a4. The trimming waveform PA and the trimming waveform PB have different voltage displacement differences at the time point t2. Hence, as illustrated in FIG. 17, the correction amount (correction range) of the discharge speed can be changed depending on which of the trimming waveform PA and the trimming waveform PB is used.

Figure 18:
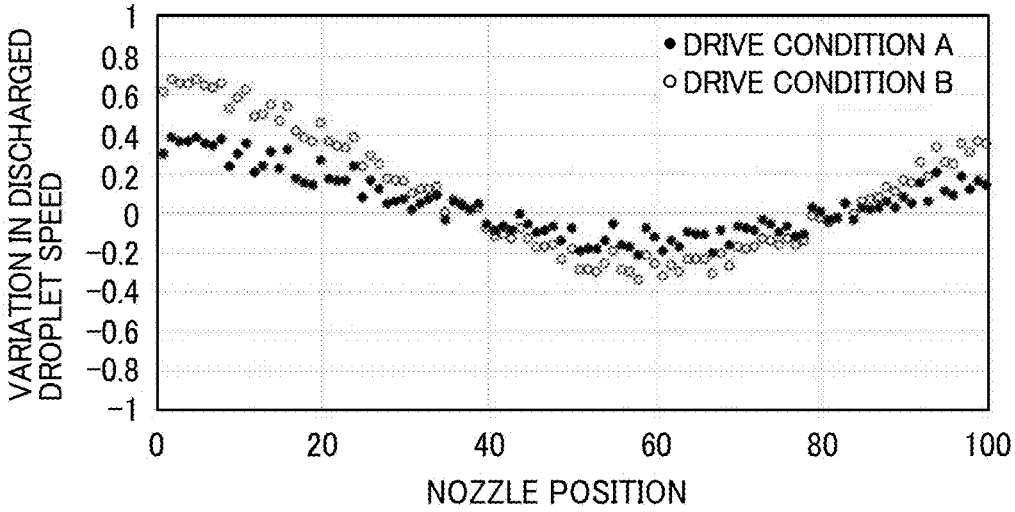
FIG. 18 is a graph illustrating an example of the relationship between different drive conditions and variations in discharged droplet speed corresponding to nozzle positions in a sixth embodiment of the present disclosure.

With reference to FIGS. 18 to 20, a description is given of a sixth embodiment of the present disclosure. FIG. 18 is a graph illustrating an example of the relationship between different drive conditions and variations in discharged droplet speed corresponding to nozzle positions in the sixth embodiment. FIG. 19 and FIG. 20 are tables of different examples of the relationship between the drive conditions and the selection signals.

As illustrated in FIG. 19, the variation range of the discharged droplet speed is different between the drive condition A and the drive condition B, and the variation range is larger in the drive condition B than in the drive condition A.

Here, the drive conditions A and B are, for example, a difference in head drive frequency as illustrated in FIG. 19 or a difference in printing resolution (print mode or discharge mode) as illustrated in FIG. 20.

Hence, the trimming waveforms PA and PB trimmed by the selection signals A and B described in the fifth embodiment are used to correct in-head variations of the discharged droplet speed.

In other words, in the example of FIG. 19, for the drive condition A of a head drive frequency 10 kHz, the selected waveform A is used to correct the discharge speed with the trimming waveform PA, and for the drive condition B of a head drive frequency 60 kHz, the selected waveform B is used to correct the discharge speed with the trimming waveform PB.

In the example of FIG. 20, for the drive condition A of 1200×1200 dpi, the selected waveform A is used to correct the discharge speed with the trimming waveform PA, and for the drive condition B of 600×600 dpi, the selected waveform B is used to correct the discharge speed with the trimming waveform PB.

In this way, even if the drive conditions are different, correction can be performed while the trimming value (time point t2) for each nozzle remains common.

As described above, the waveform trimming is performed by using the intermediate potential portion (the second-stage holding waveform element a3) immediately before the expansion waveform element of the drive pulse of the common drive waveform. Thus, discharge variation can be corrected even for a head having a short natural cycle.

Figure 21:
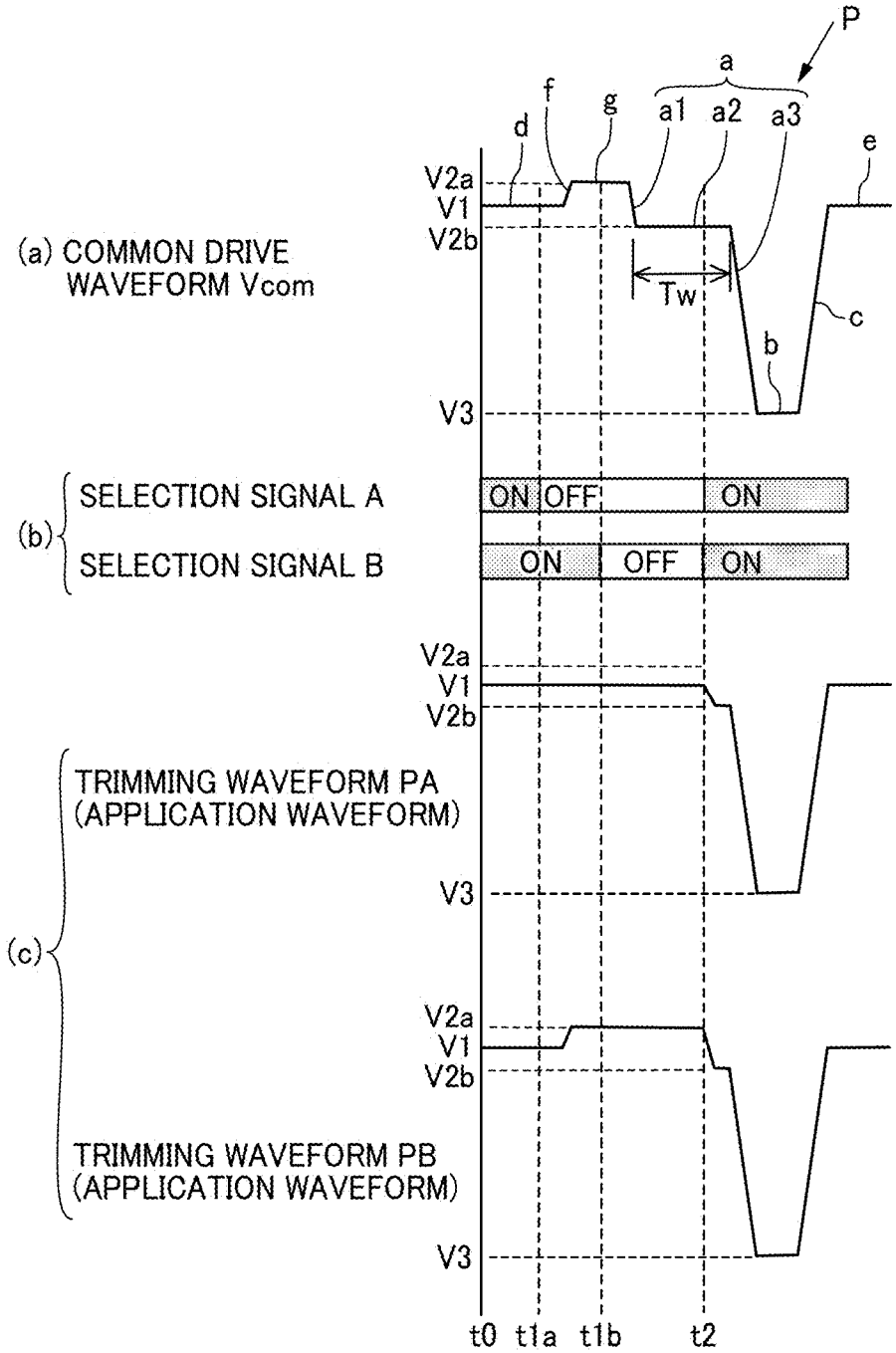
FIG. 21 is a graph illustrating drive waveforms and selection signals in a seventh embodiment of the present disclosure.

Next, a seventh embodiment of the present disclosure is described with reference to FIG. 21. FIG. 21 is a graph illustrating a common drive waveform, a selection signal, and an application waveform (trimming waveform) applied to a pressure generating element in the seventh embodiment.

As illustrated in part (a) of FIG. 21, a common drive waveform Vcom of the present embodiment includes a drive pulse P as a discharge pulse for pressurizing the pressure chamber 21 to discharge liquid. The drive pulse P is a pulse for discharging, for example, a small droplet.

The drive pulse P includes an expansion waveform element a for expanding the pressure chamber 21, a holding waveform element b for holding an expansion state of the pressure chamber 21 expanded by the expansion waveform element a, and a contraction waveform element c for contracting the pressure chamber 21 from the expansion state held by the holding waveform element b to discharge liquid.

The drive pulse P includes, before the expansion waveform element a, a pre-contraction waveform element f for contracting the pressure chamber 21 and a pre-holding waveform element g for holding the state contracted by the pre-contraction waveform element f. The expansion waveform element a expands the pressure chamber 21 from the state held by the pre-holding waveform element g.

The pre-contraction waveform element f rises from an intermediate potential (or reference potential) V1 to a potential V2*a* (V2*a*>V1). The pre-holding waveform element g holds the potential V2 that is a terminal potential of the pre-contraction waveform element f.

In the present embodiment, the expansion waveform element a is a waveform that performs two-stage expansion. The expansion waveform element a includes a first-stage expansion waveform element a1 that starts with the potential V2*a* held by the pre-holding waveform element g as a start potential and falls to a potential V2*b* (V2*b*<V1), a first-stage holding waveform element a2 for holding the potential V2*b*, and a second-stage expansion waveform element a3 that falls from the potential Vb2 to a potential V3.

The holding waveform element b holds the potential V3 that is a terminal potential of the second-stage expansion waveform element a3 of the expansion waveform element a. That is, in the present embodiment, the second-stage expansion waveform element a3 is an expansion waveform element having, as a terminal, the state (potential) held by the holding waveform element b.

The contraction waveform element c rises from the held potential V3 to the intermediate potential V1.

On the other hand, as illustrated in part (b) of FIG. 21, the head controller 401 outputs the selection signal A or B as the selection signal MN for selecting the drive pulse P. As in the first embodiment, the selection signal N for selecting all of the drive pulse P can also be output.

The selection signal A is "ON" from time point t0, transitions from "ON" to "OFF" in the middle of the intermediate-potential holding waveform element d (time point t1*a*), and transitions from "OFF" to "ON" in the middle of the first-stage holding waveform element a2 (time point t2).

The selection signal B is "ON" from time point t0, transitions from "ON" to "OFF" in the middle of the pre-holding waveform element g (time point t1*b*), and transitions from "OFF" to "ON" in the middle of the first-stage holding waveform element a2 (time point t2).

In other words, the selection signals A and B deselect a part of the waveform portion preceding the middle of the first-stage holding waveform element a2, which is a waveform portion preceding the second-stage expansion waveform element a3 having the state (potential V3) held by the holding waveform element b as the terminal.

Accordingly, when the selection signal A is output, as illustrated in part (c) of FIG. 21, a trimming waveform PA, in which the intermediate-potential holding waveform element d extends to the time point t2 and falls from the time point t2 to the potential V2*b* of the first-stage holding waveform element a2, is applied to the piezoelectric element 42 as the application waveform. The trimming waveform PA does not include the pre-contraction waveform element f.

When the selection signal B is output, as illustrated in part (c) of FIG. 21, a trimming waveform PB, in which the potential V2*a* held by the pre-holding waveform element g extends to the time point t2 and falls from the time point t2 to the potential V2*b* of the first-stage holding waveform element a2, is applied to the piezoelectric element 42 as the application waveform.

Using the trimming waveforms PA and PB of the present embodiment can reduce variations in the discharge characteristics for different drive conditions as described in the sixth embodiment.

In each of the above-described embodiments, the expansion waveform element is a waveform element that performs two-stage or three-stage expansion. However, the expansion waveform element may be a waveform element that performs expansion of four or more stages. In a case in which multistage expansion is performed as described above, the expansion waveform element of the final stage is a waveform element having an expansion state held by the holding waveform element as a terminal (potential).

In addition, in each of the above-described embodiments, an example in which two or more types of signals are included in the selection signal MN is described. However, a plurality of waveform portions may be designated by one type of selection signal MN.

Figure 22:
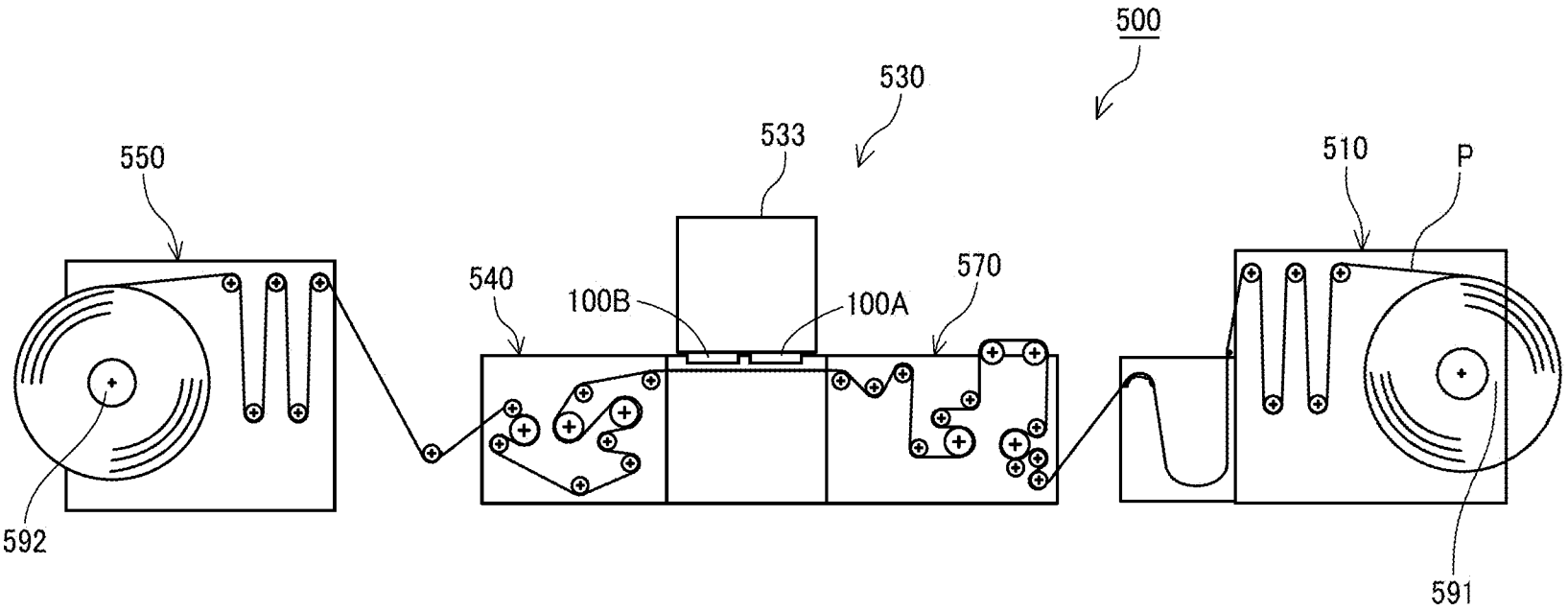
FIG. 22 is a schematic view of a printer as a liquid discharge apparatus according to an eighth embodiment of the present disclosure.
Figure 23:
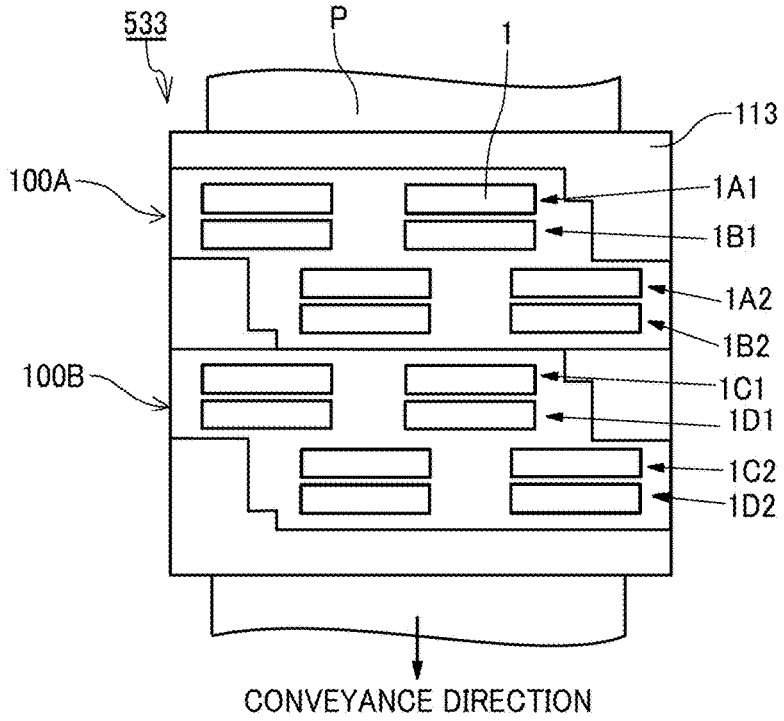
FIG. 23 is an illustration of a discharge unit of the printer according to the eighth embodiment.

Next, a printer as a liquid discharge apparatus according to an eighth embodiment of the disclosure is described with reference to FIGS. 22 and 23. FIG. 22 is a schematic view of the printer according to the eighth embodiment. FIG. 23 is an illustration of a discharge unit of the printer.

A printer 500 according to the present embodiment includes a loading unit 510 to load a sheet P such as a continuous body, a roll sheet, or a web, a printing unit 530 to discharge liquid onto the sheet P to perform printing, a guide conveyance unit 570 to guide and convey the sheet P carried in from the loading unit 510 to the printing unit 530, a drying unit 540 to dry the sheet P, and an unloading unit 550 to carry out the sheet P.

The sheet P is fed from an original winding roller 591 of the loading unit 510, guided and conveyed by rollers of the loading unit 510, the guide conveyance unit 570, the drying unit 540, and the unloading unit 550, and wound by a winding roller 592 of the unloading unit 550.

In the printing unit 530, the sheet P is conveyed to face a discharge unit 533, and an image is printed on the sheet P by the liquid discharged from the discharge unit 533.

Here, the discharge unit 533 includes two head modules 100A and 100B on a common base member 113.

When a direction in which heads 1 are aligned in the head module 100 in a direction orthogonal to the conveyance direction and is defined as a head alignment direction, head rows 1A1 and 1A2 of the head module 100A discharge the liquid of the same color. Similarly, a pair of head rows 1B1 and 1B2 of the head module 100A, a pair of head rows 1C1 and 1C2 of the head module 100B, and a pair of head rows 1D1 and 1D2 discharges liquids of required colors, respectively.

Figure 24:
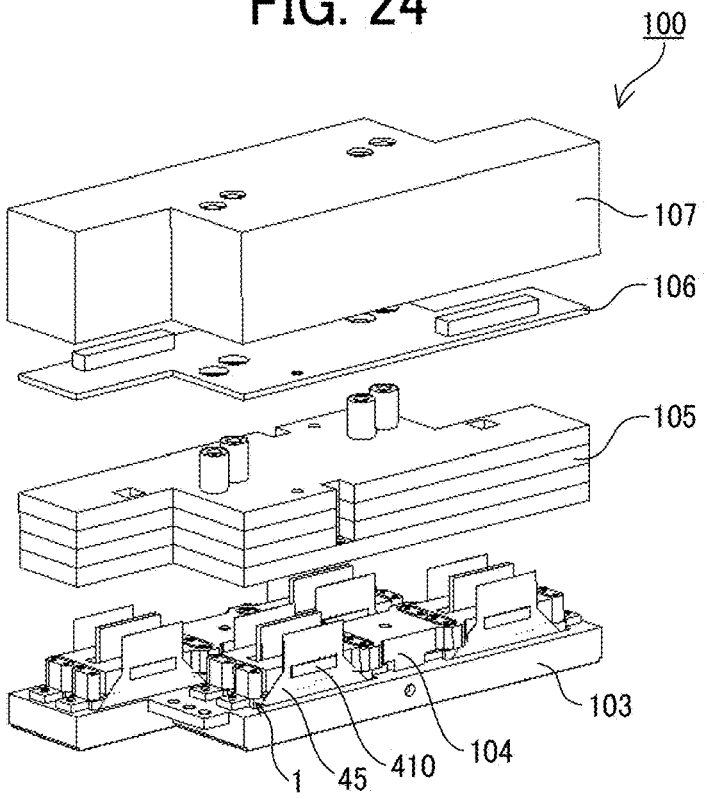
FIG. 24 is an exploded perspective view of an example of a head module in the eighth embodiment.
Figure 25:
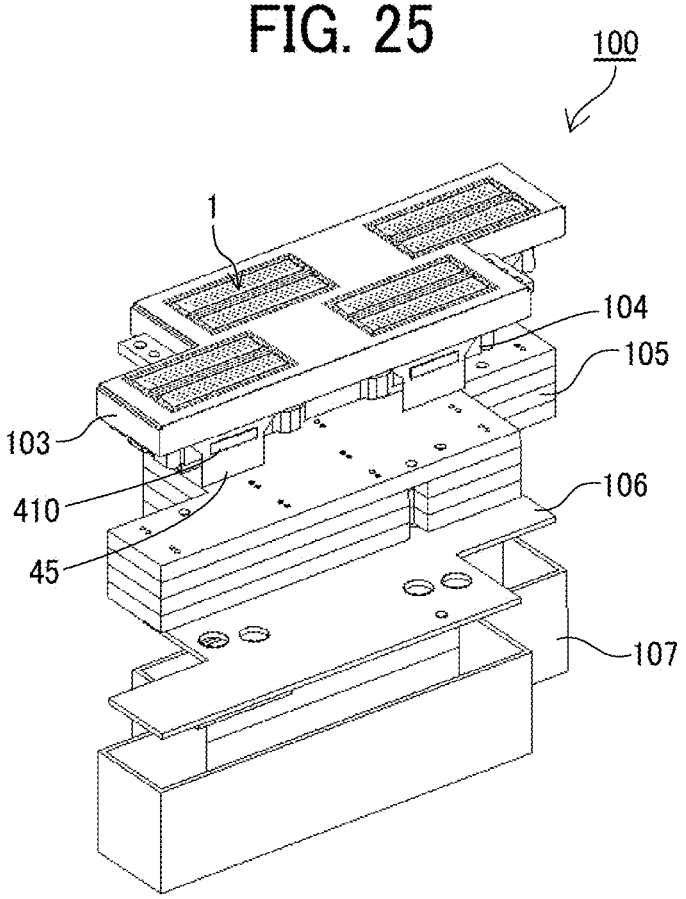
FIG. 25 is an exploded perspective view of the head module of FIG. 24 as viewed from a nozzle surface side.

Next, an example of the head module according to the present embodiment is described with reference to FIGS. 24 and 25. FIG. 24 is an exploded perspective view of the head module. FIG. 25 is an exploded perspective view of the head module as viewed from a nozzle surface side.

The head module 100 includes a plurality of heads 1, which are liquid discharge heads to discharge liquid, and a base member 103 that holds the plurality of heads 1.

In addition, the head module 100 includes a heat dissipation member 104, a manifold 105 forming channels to supply liquid to the plurality of heads 1, a printed circuit board (PCB) 106 connected to wiring boards (or flexible wiring members) 101, and a module case 107.

Figure 26:
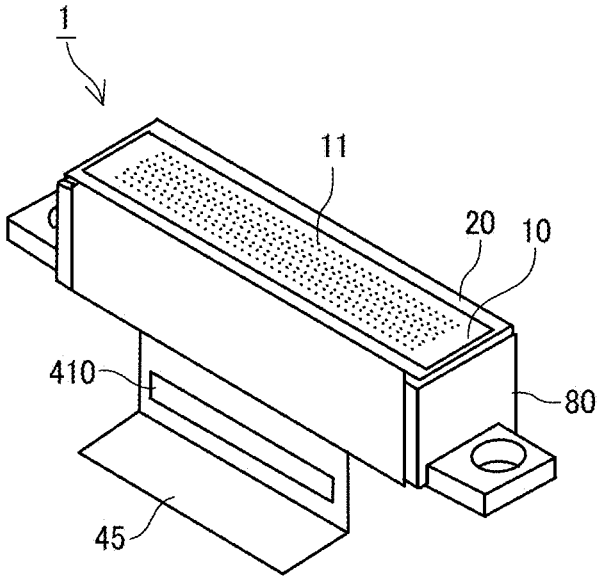
FIG. 26 is an external perspective view of an example of a head according to the eighth embodiment as viewed from a nozzle surface side.
Figure 27:
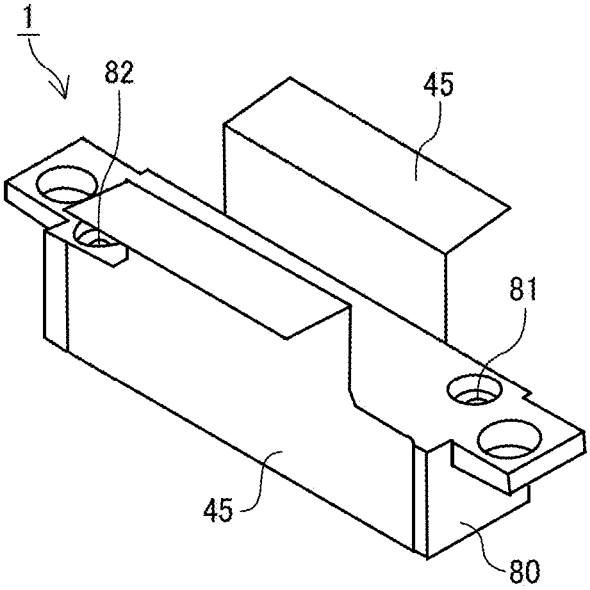
FIG. 27 is an exploded perspective view of the head according to the eighth embodiment as viewed from the opposite side of the nozzle surface side.
Figure 28:
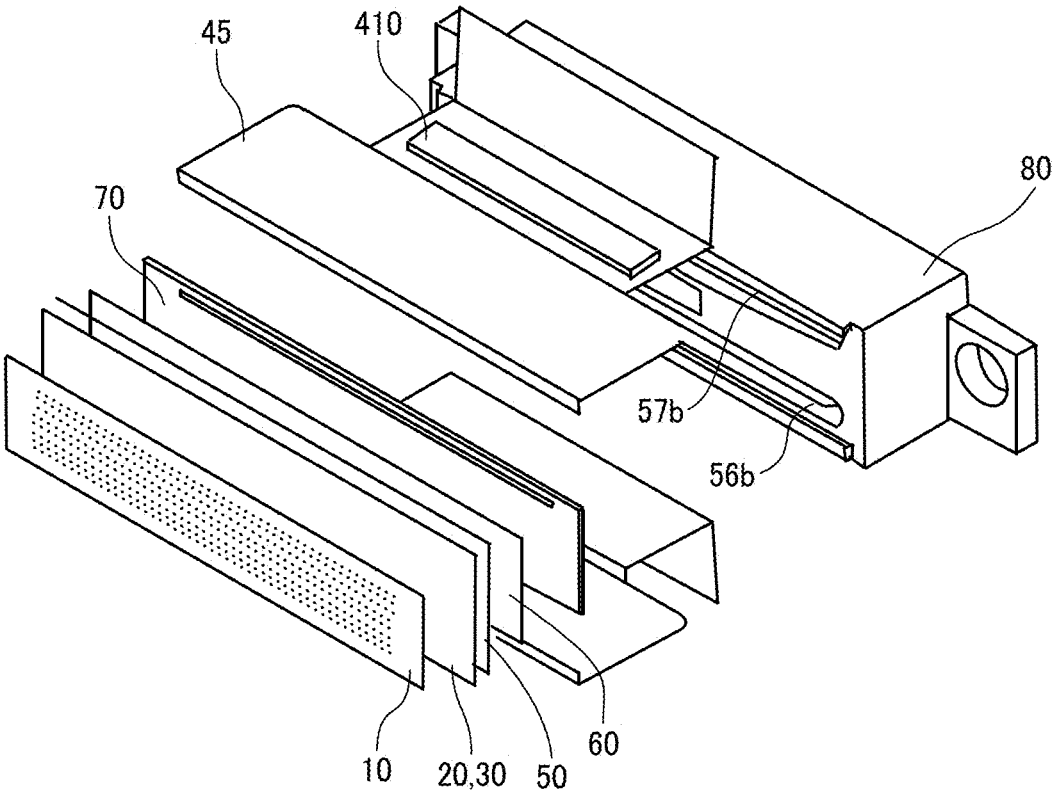
FIG. 28 is an exploded perspective view of the head according to the eighth embodiment.
Figure 29:
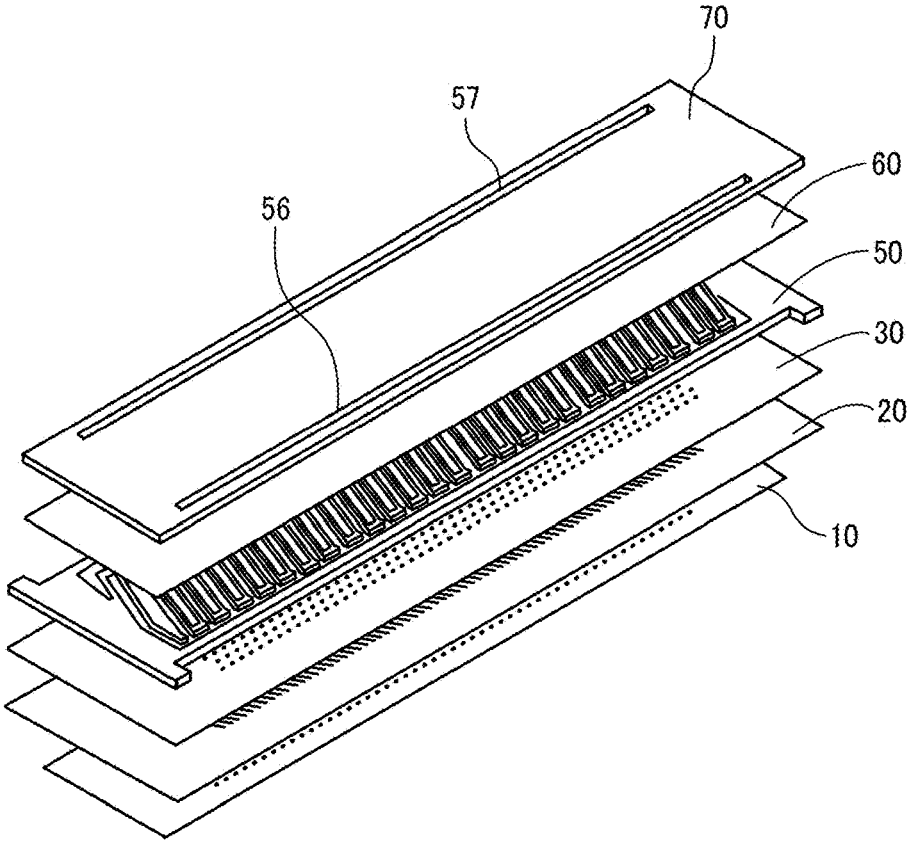
FIG. 29 is an exploded perspective view of channel forming members according to the eighth embodiment.
Figure 30:
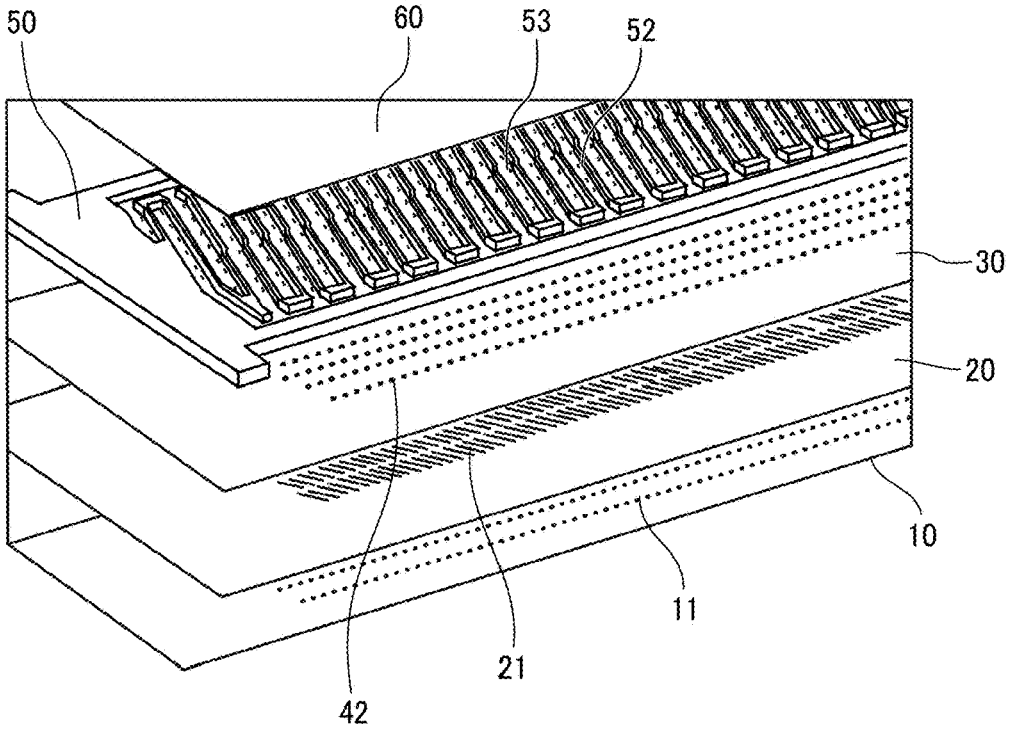
FIG. 30 is an enlarged perspective view of a main part of the channel forming members of FIG. 29.
Figure 31:
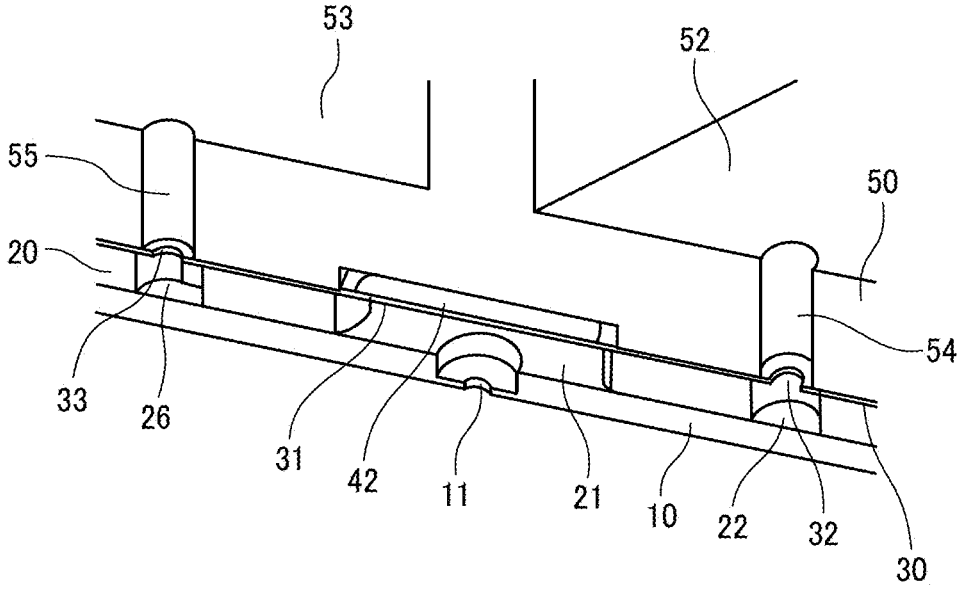
FIG. 31 is a cross-sectional perspective view of a channel portion of the channel forming members of FIG. 29.

Next, an example of the head in the present embodiment is described with reference to FIGS. 26 to 31. FIG. 26 is an external perspective view of the head as viewed from the nozzle surface side. FIG. 27 is an external perspective view of the head as viewed from the side opposite to the nozzle surface. FIG. 28 is an exploded perspective view of the head. FIG. 29 is an exploded perspective view of channel forming members. FIG. 30 is an enlarged perspective view of a main part of the channel forming members illustrated in FIG. 29. FIG. 31 is a sectional perspective view of a channel portion of the channel forming members illustrated in FIG. 29.

The head 1 includes, e.g., a nozzle plate 10, a channel plate (individual channel substrate) 20, a diaphragm substrate 30, a common channel substrate 50, a damper substrate 60, a common channel substrate 70, a frame substrate 80, and a wiring member (flexible wiring board) 45. A head driver (driver IC) 410 is mounted on the wiring member 45.

The nozzle plate 10 includes a plurality of nozzles 11 to discharge liquid. The plurality of nozzles 11 are arranged in a two-dimensional matrix.

The individual channel substrate 20 forms a plurality of pressure chambers (individual liquid chambers) 21 that communicate with the plurality of nozzles 11, a plurality of individual supply channels 22 that communicate with the plurality of pressure chambers 21, and a plurality of individual collection channels 26 that communicate with the plurality of pressure chambers 21. One pressure chamber 21 and one of the individual supply channels 22 and one of the individual collection channels 26 that communicate with this pressure chamber 21 are collectively referred to as an individual channel 25.

The diaphragm substrate 30 forms a diaphragm 31 that is a deformable wall of the pressure chamber 21. The diaphragm 31 is integrated with a piezoelectric element 42. Further, the diaphragm substrate 30 includes a supply-side opening 32 that communicates with the individual supply channel 22 and a collection-side opening 33 that communicates with the individual collection channel 26. The piezoelectric element 42 is a pressure generator that deforms the diaphragm 31 to pressurize liquid in the pressure chamber 21.

The individual channel substrate 20 and the diaphragm substrate 30 are not limited to be separate members. For example, the individual channel substrate 20 and the diaphragm substrate 30 may be integrated as a single member using an SOI (Silicon on Insulator) substrate. That is, an SOI substrate in which a silicon oxide film, a silicon layer, and a silicon oxide film are formed in this order on a silicon substrate can be used. The silicon substrate serves as the individual channel substrate 20, and the silicon oxide film, the silicon layer, and the silicon oxide film constitute the diaphragm 31. In such a configuration, the layer structure of the silicon oxide film, the silicon layer, and the silicon oxide film of the SOI substrate constitutes the diaphragm substrate 30. Thus, the diaphragm substrate 30 may be composed of materials formed as films on the surface of the individual channel substrate 20.

The common channel substrate 50 is a common channel branch member, and includes a plurality of common supply channel tributaries 52 that communicate with two or more individual supply channels 22 and a plurality of common collection channel tributaries 53 that communicate with two or more individual collection channels 26. The plurality of common supply channel tributaries 52 and the plurality of common collection channel tributaries 53 are alternately arranged adjacent to each other.

The common channel substrate 50 forms a through hole serving as a supply port 54 that communicates the supply-side opening 32 of the individual supply channel 22 with the common supply channel tributary 52, and another through hole serving as a collection port 55 that communicates the collection-side opening 33 of the individual collection channel 26 with the common collection channel tributary 53.

Further, the common channel substrate 50 forms a part 56*a* of the one or more common supply channel mainstreams 56 communicating with the plurality of common supply channel tributaries 52 and a part 57*a* of one or more common collection channel mainstreams 57 communicating with the plurality of common collection channel tributaries 53.

The damper substrate 60 includes a supply-side damper 62 that faces (or opposes) the supply port 54 of the common supply channel tributary 52, and a collection-side damper 63 that faces (or opposes) the collection port 55 of the common collection channel tributary 53.

Here, the common supply channel tributary 52 and the common collection channel tributary 53 are configured by sealing groove portions alternately arranged in the common channel substrate 50, which is the same member, with the damper substrate 60 forming a deformable wall surface.

The common channel substrate 70 is a common channel mainstream member and forms a common supply channel mainstream 56 communicating with the plurality of common supply channel tributaries 52 and a common collection channel mainstream 57 communicating with the plurality of common collection channel tributaries 53.

A part 56*b* of the common supply channel mainstream 56 and a part 57*b* of the common collection channel mainstream 57 are formed in the frame substrate 80. The part 56*b* of the common supply channel mainstream 56 communicates with the supply port 81 provided in the frame substrate 80. The part 57*b* of the common collection channel mainstream 57 communicates with the collection port 82 provided in the frame substrate 80.

In the head 1, liquid passes from the common supply channel mainstream 56 through the common supply channel tributary 52, is supplied from the supply port 54 to the pressure chamber 21, and is discharged from the nozzle 11. The liquid not discharged from the nozzle 11 passes through the collection port 55, the common collection channel tributary 53, and the common collection channel mainstream 57, and is supplied again to the common supply channel mainstream 56 through the collection port 82, an external circulation device, and the supply port 81.

As described above, the head drive control according to any of the first to seventh embodiments can be applied to the case in which the head 1 includes the nozzles 11 arranged in a two-dimensional matrix.

In embodiments of the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

Examples of the liquid discharge apparatus include, not only apparatuses capable of discharging liquid to materials to which liquid can adhere, but also apparatuses to discharge a liquid toward gas or into a liquid.

The liquid discharge apparatus can include at least one of devices for feeding, conveying, and ejecting a material to which liquid can adhere. The liquid discharge apparatus can further include at least one of a pretreatment apparatus and a post-treatment apparatus.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus that discharges liquid to visualize meaningful images such as letters or figures. For example, the liquid discharge apparatus may be an apparatus that forms meaningless images such as meaningless patterns or an apparatus that fabricates three-dimensional images.

The above-described term "material on which liquid can be adhered" denotes, for example, a material or a medium onto which liquid is adhered at least temporarily, a material or a medium onto which liquid is adhered and fixed, or a material or a medium onto which liquid is adhered and into which the liquid permeates. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

The "material on which liquid can be adhered" is made of any material provided that liquid is adherable at least temporarily to the material. For example, the "material to which liquid is adherable" may be made of paper, threads, fibers, fabric, leather, metal, plastic, glass, wood, or ceramic.

The liquid discharge apparatus (apparatus for discharging liquid) may be an apparatus to relatively move a liquid discharge head and a material on which liquid can be adhered. However, the apparatus for discharging liquid is not limited to such an apparatus. The liquid discharge apparatus may be, for example, a serial-type apparatus to move a liquid discharge head relative to a sheet material or a line-type apparatus that does not move a liquid discharge head relative to a sheet material.

Examples of the liquid discharge apparatus further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" are herein used as synonyms.

Embodiments of the present disclosure are not limited to the elements described in the above-described embodiments. The elements of the above-described embodiments can be modified without departing from the gist of the present disclosure, and can be appropriately determined according to the application form. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge apparatus, comprising:

a liquid discharge head including a nozzle to discharge liquid;

circuitry configured to:

generate and output a common drive waveform including a drive pulse for discharging liquid from the nozzle of the liquid discharge head;

select a waveform portion of the drive pulse to be applied to a pressure generating element of the liquid discharge head; and output a selection signal for designating the waveform portion selected, wherein the drive pulse includes at least an expansion waveform element for expanding a pressure chamber of the liquid discharge head and a holding waveform element for holding a state expanded by the expansion waveform element, wherein the selection signal includes a deselection signal for deselecting at least a part of a waveform portion preceding the expansion waveform element having, as a terminal, a state held by the holding waveform element, wherein the drive pulse includes a first-stage expansion waveform element for expanding the pressure chamber, a first-stage holding waveform element for holding a state expanded by the first-stage expansion waveform element, and a second-stage expansion waveform element for expanding the pressure chamber from a state held by the first-stage holding waveform element, wherein the second-stage expansion waveform element is a waveform element having, as a terminal, the state held by the holding waveform element, and wherein the deselection signal is a signal for deselecting a waveform portion that includes at least from a start of the first-stage holding waveform element of the drive pulse to a middle of the first-stage holding waveform element of the drive pulse in the common drive waveform.

2. The liquid discharge apparatus according to claim 1, wherein the selection signal includes the circuitry is configured to output a plurality of selection signals for deselecting a waveform portion that is a part of the driving pulse, and the waveform portion deselected is different between the plurality of selection signals.

3. The liquid discharge apparatus according to claim 1, wherein the selection signal is different depending on a drive frequency.

4. The liquid discharge apparatus according to claim 1, wherein the selection signal is different depending on a discharge mode.

5. The liquid discharge apparatus of claim 1, wherein the deselected waveform portion maintains a state different from the state of the holding waveform element.

6. A head drive control device, comprising:

circuitry configured to:

generate and output a common drive waveform including a drive pulse for discharging liquid from a nozzle of a liquid discharge head;

select a waveform portion of the drive pulse to be applied to a pressure generating element of the liquid discharge head; and output a selection signal for designating the waveform portion selected, wherein the drive pulse includes at least an expansion waveform element for expanding a pressure chamber of the liquid discharge head and a holding waveform element for holding a state expanded by the expansion waveform element, wherein the selection signal includes a deselection signal for deselecting at least a part of a waveform portion preceding the expansion waveform element having, as a terminal, a state held by the holding waveform element, wherein the drive pulse includes a first-stage expansion waveform element for expanding the pressure chamber, a first-stage holding waveform element for holding a state expanded by the first-stage expansion waveform element, and a second-stage expansion waveform element for expanding the pressure chamber from a state held by the first-stage holding waveform element, wherein the second-stage expansion waveform element is a waveform element having, as a terminal, the state held by the holding waveform element, and wherein the deselection signal is a signal for deselecting a waveform portion that includes at least from a start of the first-stage holding waveform element of the drive pulse to a middle of the first-stage holding waveform element of the drive pulse in the common drive waveform.

7. The head drive control device of claim 6, wherein the deselected waveform portion maintains a state different from the state of the holding waveform element.

* * * * *